United States Patent [19]

Gluz et al.

[11] 4,378,940

[45] Apr. 5, 1983

[54] ELECTRONIC DEVICE FOR PLAYING BINGO, LOTTO AND ALLIED CARD GAMES

[76] Inventors: Jacob Gluz, 799 Pitcairn Dr., Foster City, Calif. 94404; Benjamin Poku, P.O. Box 1494, New Haven, Conn. 06506

[21] Appl. No.: 215,351

[22] Filed: Dec. 11, 1980

[51] Int. Cl.[3] ..... A63F 3/06

[52] U.S. Cl. ..... 273/237; 273/269

[58] Field of Search ..... 273/269, 237; 364/410, 364/411, 412

[56] References Cited

U.S. PATENT DOCUMENTS 3,786,234 1/1974 Trent et al. ..... 364/412
4,007,443 2/1977 Bromberg et al. ..... 340/172.5
4,019,174 4/1977 Vanderpool et al. ..... 340/172.5
4,080,596 3/1978 Keck et al. ..... 273/237

*Primary Examiner*—Vance Y. Hum
*Assistant Examiner*—Leo P. Picard
*Attorney, Agent, or Firm*—Ilya Zborovsky

[57] ABSTRACT

An electronic device comprising a master controller, numeric and alphanumeric displays, a numeric keyboard, control buttons, a pattern-input switch matrix, a card-input assembly and an optional audio module—all in one unit—automatically reads coded numbers on a card, accepts numbers as well as patterns whereupon it indicates by visual and optionally audible means when a win (i.e. "BINGO") occurs. The basic device can easily be adapted so it can be used to play other card games besides BINGO, (e.g. LOTTO).

11 Claims, 47 Drawing Figures

DEVICE LAYOUT

2114 - STANDARD 1K BY 4 STATIC RAM

I/O ADDRESSES (ALPHANUMERIC)

ALL ADDRESSES ARE IN HEXADECIMAL

6

| | | | | | | | | | | | | | | | |
|---|---|---|---|---|---|---|---|---|---|---|---|---|---|---|---|
| AFH | AEH | ADH | ACH | BFH | BEH | BDH | BCH | CFH | CEH | CDH | CCH | DFH | DEH | DDH | DCH | EFH | EEH | EDH | ECH |

KEYBOARD I/O ADDRESS :80H

KEYBOAR FLAG I/O ADDRESS :87H

CARD INPUT I/O ADDRESS :88H

CARD INPUT FLAG I/O ADDRESS :8FH

FIG. 6

I/O ADDRESS DECODER

1 OF 5 CIRCUITS (SEE ALPHANUMERIC I/O ADDRESS TABLE AND LAYOUT)

DL-1416-LITRONIX
FOUR-CHARACTER ALPHANUMERIC
"INTELLIGENT DISPLAY"TM
WITH MEMORY/DECODER/DRIVER

KEYBOARD LED CIRCUITS

FIG. 15A
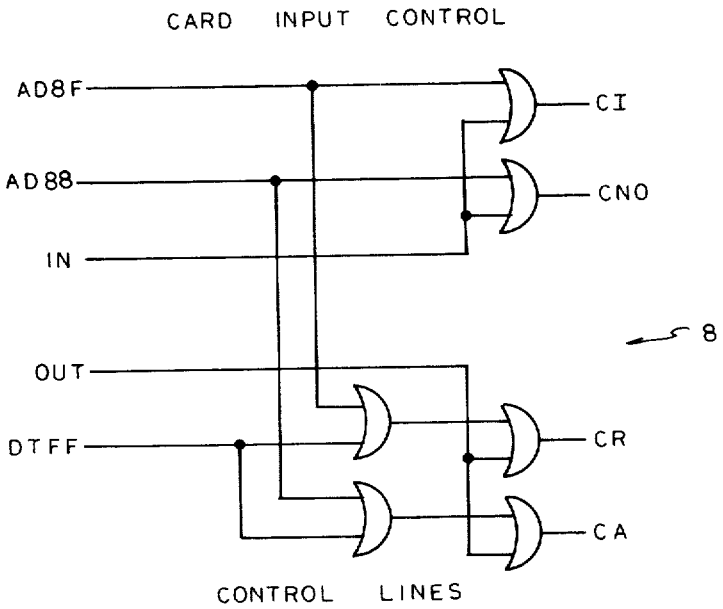
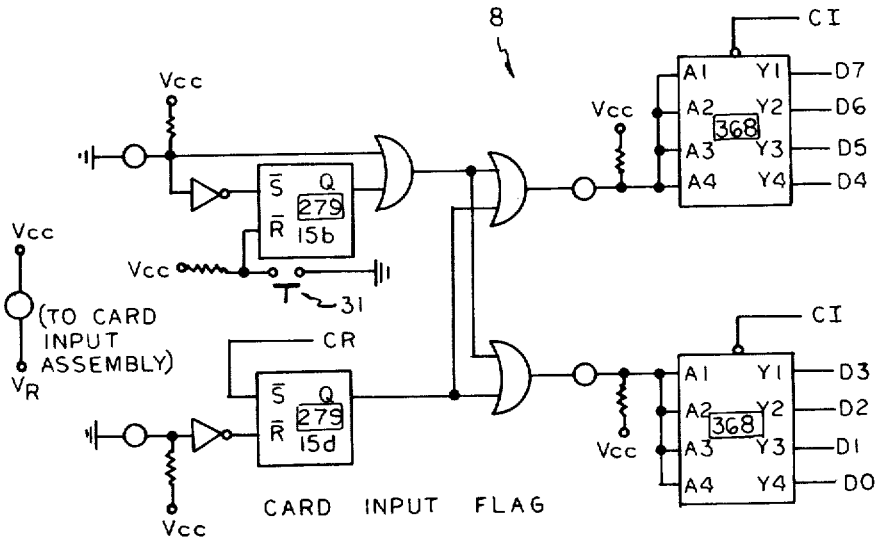
O CONTINUITY IS ESTABLISHED WHEN CORD IS SECURED ON READER ASSEMBLY
FIG. 15B

O CONTINUITY MAY BE ESTABLISHED ONLY WHEN CARD TO BE READ IS IN PLACE

CARD READER SENSING CIRCUITRY

1 OF 48 CIRCUITS

BINGO CARD

OBINARY ENCODING

CARD ENCODING AND READING

FIG. 19A

| | | | | |
|---|---|---|---|---|
| 1st | 6th | 11th | 16th | 21st |
| 2nd | 7th | 12th | 17th | 22nd |
| 3rd | 8th | 13th | 18th | 23rd |
| 4th | 9th | 14th | 19th | 24th |
| 5th | 10th | 15th | 20th | 25th |

ORDER IN WHICH MACHINE-CODED NUMBERERS ARE AVAILABLE AT CARD READER OUTPUT

FIG. 19B

| | | | | |
|---|---|---|---|---|
| 12 | 28 | 39 | 59 | 70 |
| 8 | 19 | 45 | 48 | 65 |
| 7 | 18 | FREE | 55 | 74 |
| 2 | 24 | 35 | 60 | 67 |
| 11 | 27 | 34 | 51 | 61 |

ACTUAL BINGO CARD FIGURES (SAMPLE)

FIG. 19C

| | | | | |
|---|---|---|---|---|
| 12 | 13 | 9 | 14 | 10 |
| 8 | 4 | 15 | 3 | 5 |
| 7 | 3 | 0 | 10 | 14 |
| 2 | 9 | 5 | 15 | 7 |
| 11 | 12 | 4 | 6 | 1 |

CORRESPONDING MACHINE-CODED FIGURES

ELECTRONIC DEVICE FOR PLAYING BINGO, LOTTO AND ALLIED CARD GAMES

BACKGROUND OF THE INVENTION

BINGO is a very popular game that is played as follows: players are given (or buy) a number of cards. On each card is printed a matrix of twenty-five squares arranged in a square array of five contiguous columns by five contiguous rows. Each square in the array is labelled with a distinct whole number. Numbers in column one must be between one and fifteen inclusive, numbers in column two must be between sixteen and thirty inclusive, numbers in column three must be between thirty-one and forty-five inclusive, numbers in column four must be between forty-six and sixty inclusive and numbers in column five must be between sixty-one and seventy-five inclusive. The number in the square at the center of the array (column three, row three) is free on each card. Additionally columns one through five are associated with the letters B, I, N, G, and O respectively. A person referred to as the dealer (or caller) indicates at the beginning of the game what particular pattern on a card (regularly any row, column or diagonal) constitutes "BINGO," in other words, a win. The dealer then randomly draws a number—an integer between one and seventy-five inclusive. Any player whose card has that particular number puts a marker on the appropriate square on his or her card(s). The dealer continues to draw numbers randomly and the players mark their cards as appropriate. Any player who achieves the pre-announced winning pattern of called numbers on any of his or her cards shouts "BINGO" and the game either ends or continues depending on the pre-established rules.

Several attempts have been made to automate Bingo playing but nearly all of these relate to the random selection of the numbers by the dealer (or caller)—for example, Keck & Viola in U.S. Pat. No. 4,080,596; Friedman in U.S. Pat. No. 3,895,807; Hurley in U.S. Pat. No. 3,653,026; Hofsetz in U.S. Pat. No. 2,594,434 and Goloborodko in U.S. Pat. No. 2,333,002.

Only two devices, as known to the present inventors, appear to take the player also into account: Peak in U.S. Pat. No. 2,760,619 describes an electrical panel on which twenty-five lights are positioned. The lights are lighted to correspond with numbers called out by the dealer. The whole panel is connected to player boards. But it is evident that the apparatus requiring dependence of player boards on the master panel is cumbersome and inconvenient to the player. Besides each player board replaces the BINGO card itself.

Likewise Taylor & Whitaker in U.S. Pat. No. 3,671,041 describe a player console having multiple groups of playing boards all tied to a master control board. Again this device is cumbersome. Furthermore, the player console is attached to the master control board which setup severely limits the player's independence. The player console also takes the place of a set of the familiar BINGO cards. The player thus requires as many panels as the desired number of equivalent sets of BINGO cards. The master control board has in effect complete control of the game while the players merely sit and watch their panels.

SUMMARY OF THE INVENTION

An objective of the present invention is to enable the BINGO player, even though using an electronic device, to continue to retain his or her independence from the dealer (or caller) and experience as much excitement and pleasure as is customary in the manual playing of the game. The device relieves the player from major playing chores: First the device reads all the cards at the beginning of the game and remembers them until power is switched off. Next the device accepts called out numbers, checks for a win and informs the player by visual and optionally audible means when "BINGO," that is, a win is attained. Furthermore, the device guides the player through all phases of the game by means of helpful messages and other relevant displays.

Another objective of the invention is to provide a relatively simple means for automatically reading the cards by extending the conventional BINGO card and slightly modifying the extended end and thus largely retaining the familiar form of the BINGO card. The number of cards that can be remembered by the device is practically unlimited.

Yet another objective of the invention is to provide a means for recording not only the numbers called out by the dealer but also any pattern whatsoever that is predefined as constituting "BINGO" or equivalently a win.

Still a further objective of the invention is to provide a means for automatically displaying numbers and appropriate messages, as well as generating, optionally, appropriate sounds where desired.

An additional objective of the invention is to provide the BINGO player with a portable, self-contained, electronic device that is sturdy, durable, reliable, efficient and inexpensive, requiring little or no maintenance.

Other objectives of the invention will come in evidence as set forth in the specification and accompanying drawings.

The device described here is an integrated software/-hardware system that provides a means for two-way communication between the player and the device. All player-initiated communications take place by means of a card-input assembly and a keyboard. The machine communicates with the player through numeric/alphanumeric displays, visual indicators (LEDs) and an optional audio module.

When the machine is switched on it waits (after some initial housekeeping) for the player to issue a command. To each such command the machine performs an appropriate function and informs the player of the results through the appropriate communication modules.

The device performs the following functions among others:

1. It reads and stores numbers on a Bingo (or similar) card, automatically assigning to each such card (and its set of twenty-five numbers or other appropriate set) a sequential number (beginning with one) for identification purposes;
2. It allows the player to select either predefined winning patterns or any arbitrary pattern for each game;
3. It allows the player to view all player-selected patterns (in the form of an array of lighted LEDs or other appropriate visual indicators);
4. It allows the player to enter numbers called by the dealer;
5. It allows the player to start or end any game as appropriate;
6. It allows the player to view all cards, that is, the numbers on each such card, stored in memory;

7. It allows the player to view all winning cards after the automatic display of the first winning card;
8. It guides the player through all phases of a game by displaying appropriate messages;
9. It optionally informs the player of special events, such as a win, by appropriate sounds;
10. It allows the player to play alone or in a group.

BRIEF DESCRIPTION OF THE DRAWINGS

FIG. 6 depicts one possible layout of the alphanumeric display together with a sample I/O address assignment as well as some relevant I/O addresses (all in hexadecimal notation).

FIGS. 15*a* and 15*b* together constitute the control and flag circuits in the card reader assembly.

FIG. 19*a* shows one possible order in which the coded versions of the numbers on a BINGO card are available to the card reader.

FIG. 19*b* depicts a sample set of numbers on a BINGO card while FIG. 19*c* illustrates the corresponding pseudomodulo-fifteen representation of the sample.

DESCRIPTION OF A PREFERRED EMBODIMENT

Figure 1:
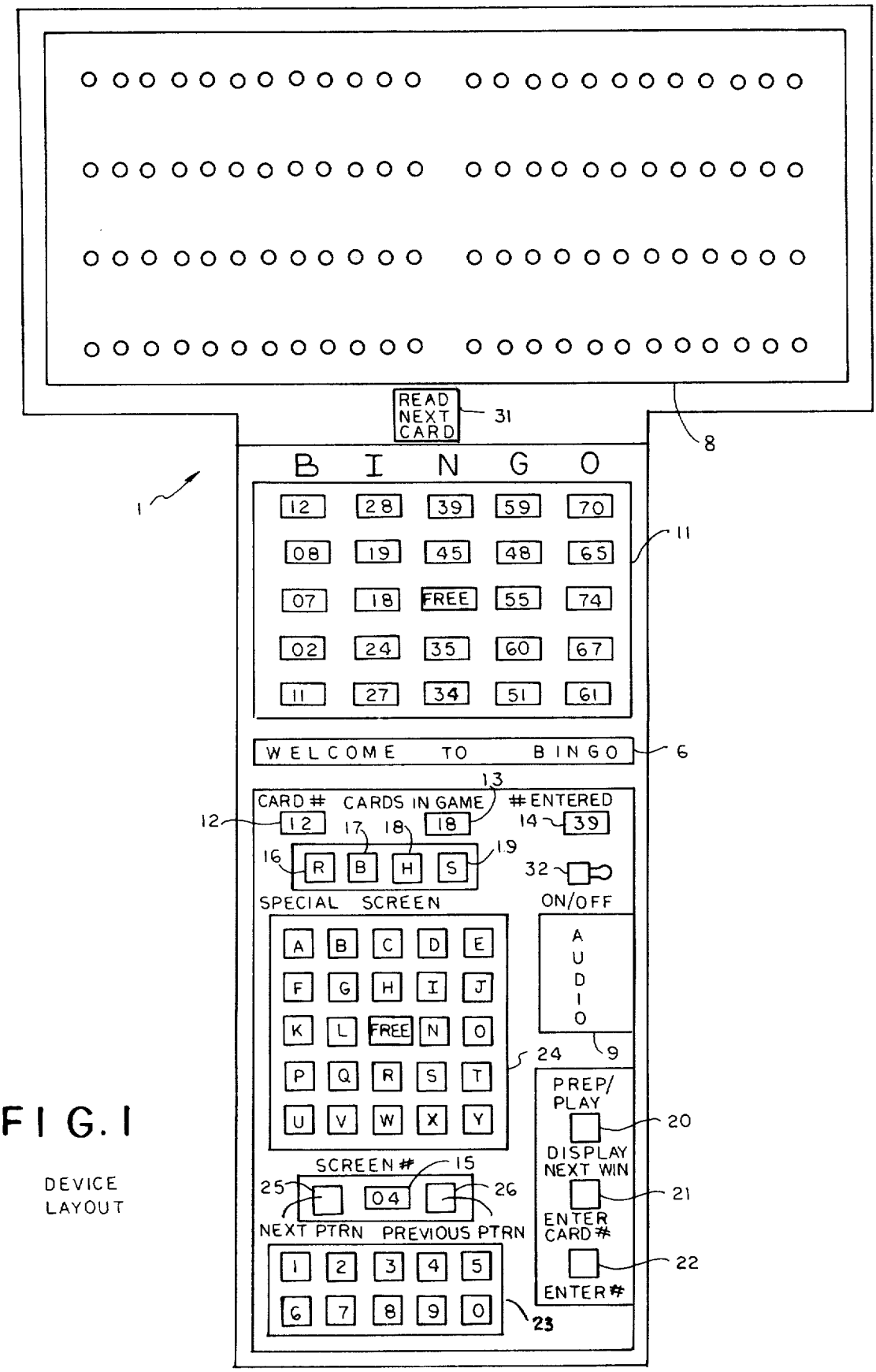
FIG. 1 is an illustration of one of numerous possible layouts for the device.

The detailed description of the present embodiment has four subsections. These subsections are titled: Interface between the player and the device, Hardware/-Software Interface, Hardware Realization and Control Program Logic. Interface between the player and the device The front panel of the device, as indicated in FIG. 1, comprises a card-input assembly 8, display screens 11, 6, 12–15, control buttons 16–22, 25–26, 31–32, a numeric pad 23, a pattern-input device 24 and an optional audio module 9. Not shown is a reset button 33 and two optional control buttons used to view called numbers which have been stored by the device. The letters B-I-N-G-O also appear optionally on the device.

Bingo screen 11 consists of at most twenty-five two-digit displays arranged in a five-by-five matrix to correspond in positions to those of the numbers on a Bingo card. This screen is used to display Bingo cards stored by the device.

Message screen 6 is a twenty-character alphanumeric display used by the device to inform the player. The messages displayed on this screen are of three types:

(a) Error Messages—e.g. "INVALID BUTTON" occasioned when the player pushes a control button that makes little sense at the time the button is pushed and the device is unable to tell which one of several alternative requests is desired.

(b) Status Messages—Such messages inform the player of the device's response to legitimate commands issued by the player, e.g. the player pushes control button 31 (labelled "READ NEXT CARD") and the machine replies with the message "CARD . . . STORED."

(c) Instructional Messages—The player pushes a control button that makes little sense at the time the button is pushed. But in this case the device can determine under the prevailing circumstances what would be the correct button to push. Hence the reply message tells the player the correct button to push: e.g. if the machine displays a winning card and the player inadvertently pushes control button 20 (labelled PREP/PLAY the response will be "HIT DISPLAY NEXT WIN."

The control buttons 16, 17, 18 and 19 (labelled R, B, H and S respectively), each of which is illuminated when pushed, are used by the player to select the type of game desired: R for Regular, B for Big, H for Hard Way and S for Special. When the R button is pushed the allowable winning patterns on a card are any row, column or diagonal. When the B button is pushed the stipulated winning patterns are columns one, two and four corresponding to the letters B, I and G on the Bingo card. (See FIG. 18.) When the H button is pushed the acceptable winning patterns are any row or column except the middle row and middle column. When the S button is pushed the proposed winning patterns are precisely those (up to eight) entered by means of the pattern-input matrix 24. If the S button is pushed then at least one pattern must be entered. Initially the device assumes mode R.

The R, B, H and S buttons are mutually exclusive in the requests they specify and may be activated only at the beginning or at the end of a game. Any attempt to change a game by pushing any one of the buttons while a game is in progress will result in the display of an error message. But before a game starts the player can change the type of game as often as desired. Each time any one of the R, B, H and S buttons is pushed the pattern screen 24 is cleared.

The pattern-input matrix 24 consists of at most twenty-five lighted pushbutton switches arranged in a five-by-five matrix. Entering a pattern is accomplished by pushing, in any order, any number of the buttons so that the desired pattern in outlined in the form of lighted LEDs associated with the buttons. Each time any one of the buttons is pushed the state of the corresponding LED is changed by the controller to either ON or OFF depending upon the LED's state before the button was pushed. Thus corrections or modifications can be made. The middle button bearing the legend "FREE" is always lighted. All other LEDs are initially off.

After specifying the pattern the player pushes either one of the control buttons 25 (labelled NEXT PATTERN) and 25 (labelled PREVIOUS PATTERN) to enter the pattern. The controller automatically assigns a sequential number to each pattern. This number appears on display 15. Initially this display shows the number one.

Control buttons 25 and 26 are also used to display stored patterns for the purposes of verification or modification. Each time control button 25 is pushed the pattern number shown on display 15 is automatically incremented by one except when the display shows the number eight in which case pushing control button 25 results in the display 15 showing the number one. In a similar fashion, on pushing control button 26 the number shown on display 15 is automatically decremented by one except when the display shows the number one in which case no change results from pushing control button 26. In all cases, however, the pattern corresponding to the number on display 15 is outlined.

The pattern-input matrix can be activated only after control button 19 has been pushed to inform the device that the player wishes to play a special game. Any attempt to use the matrix under other circumstances will result in the display of an error message on alphanumeric screen 6.

The numeric pad 23 is used by the player to enter numeric data. Data so entered appears immediately on the two-digit display 14. The last digit to be entered appears in the right-digit position while the previous digit, if any, is automatically shifted to the left-digit position.

When control button 22 is pushed it signals the device to take note of the number just entered as shown on display 14. Changes can thus be made in the number entered so that the correct number is on record. Initially screen 14 displays zero.

Control button 22 has the dual label ENTER CARD #/ENTER # indicating its dual function. As mentioned above when this button is pushed the device is commanded to note the number just entered as displayed on screen 14. But whether this number is interpreted as that of a card or as one of those called by the dealer depends upon the state of the game. The actual determination is made by the device on the basis of the state of control button 20 (labelled PREP/PLAY) as explained below.

Associated with the PREP/PLAY control button 20 are two LEDs of different colors, one color indicating the PREP mode and the other the PLAY mode. These two modes are complementary and mutually exclusive. Thus each time the button is pushed the LED that was on before the button was last pushed is turned off and simultaneously the other LED is turned on thus indicating a change in mode from either PREP to PLAY or PLAY to PREP as the case may be. When power is turned on, or reset button 33 is subsequently pushed the device assumes the PREP mode.

The state of control button 20 also determines the states of control buttons 21 and 22 labelled DISPLAY NEXT WIN and ENTER CARD #/ENTER #, respectively. When control button 20 is in the PREP mode the device places control button 21 in the inactive mode while setting control button 22 in the ENTER CARD # mode. Thus in the PREP mode of control button 20 any number entered by means of control button 22 will be interpreted as that of a card and the corresponding card, if stored in memory, will be displayed on Bingo screen 11 or else an error message will appear on alphanumeric display 6.

On the other hand, when control button 20 is in the PLAY mode control button 22 assumes the ENTER # mode. Numbers entered by means of control button 22 will thence be taken to be those called by the dealer. At the same time control button 21 is activated, that is, when pushed the device will perform the indicated request. In this mode a winning card is displayed on command by pushing control button 21 after the automatic display of the first winning card.

The device always displays, on card number screen 12, the number of the card currently on display on Bingo screen 11. Such a card may be a winning card or merely one recalled from memory before the start of a game. When no card is on display the card number screen shows zero.

The card-reading operation is initiated as follows: First the player places the card in the card-input assembly 8 and aligns the card so that it fits firmly. Next the player pushes control button 31 (labelled READ NEXT CARD). If the device reads the card the numbers are displayed on screen 11. The device also increments the number on display on the cards-in-game screen 13. The resulting number is also displayed on the card number screen 12. Since both displays 13 and 12 initially show zero the numbers they display represent respectively the total number of cards in memory to date and the number of the card currently on display on screen 11. At the same time the message "CARD . . . STORED" will appear on screen 6.

The device may choose not to read a card. As a matter of fact the machine will not read any card if the state of the PREP/PLAY control button 20 is in the PLAY mode indicating that a game is in progress. Under such circumstances an error message will appear on screen 6.

But even in the PREP mode of control button 20 the device will still not read a card if, for example, there is no more memory space to store the card. In this case the message "SORRY, NO MORE ROOM" will be displayed. Furthermore, nothing will happen at all unless the card-reading operation is initiated as indicated above.

On the other hand, when the card is in place it is sufficient to push control button 31 only once. Pushing the button more than once while the card is in place will have no further effect. As soon as the card is removed (after the reading or before control button 31 is pushed) the player can initiate the card-reading operation once more. The process is repeated for each card that is desired to be read.

The ON/OFF switch 32 controls the power supply to the device while the reset button 33 (not shown) is used to restart the program from the beginning.

HARDWARE/SOFTWARE INTERFACE

There are three procedures in the control program which are hardware-dependent. These are: Read in Button Code (Flags and Control Button Input) Procedure; Read Next Card (Card Input) Procedure and Display All Screens (I/O) Procedure. The operation is outlined below.

READ IN BUTTON CODE PROCEDURE

1. Read Keyboard Flag using I/O Address 87H.
   If data is not FFH read Card Input Flag;
   If data is FFH (signifying key down),
   Then do:
   (a) Input character using I/O Address 80H
   (b) Using I/O Address 87H output data FFH to reset keyboard
   Next do:
   (a) Identify character just read above
   (b) Take appropriate action after identification;
   (i) Using I/O Address 80H output data 80H+"Character" to turn LED on;
   (ii) Using I/O Address 80H output data 00H+"Character" to turn LED off;
   [In (i) and (ii) above "Character" means the seven-bit ASCII code for "Character" together with a concatenated eighth bit (which becomes the most significant bit) set to zero. On the other hand, addition (symbolized by +) is meant to be (hexadecimal) arithmetic (not concatenation)]
   (iii) Output appropriate message using appropriate I/O Addresses;
   (iv) Output appropriate numbers using appropriate I/O Addresses;
2. Read Card Input Flag using I/O Address 8FH.
   If data is not FFH read Keyboard Input Flag;
   If data is FFH (signifying card ready in card-input assembly),
   Then do:
   (a) Set internal code to indicate Card Input Flag set
   (b) Take appropriate action thereafter

READ NEXT CARD PROCEDURE

1. Using I/O Address 88H input number on card available at I/O port.
2. Using I/O Address 88H output data FFH to advance reader to next number on card.
3. Repeat steps (1) and (2) above till all the twenty-five numbers on a card have been read. [The thirteenth number to be read will be meaningless—actually it will be zero. Note further that the numbers on each card will be available to the processor in binary in the order shown in FIG. 19*a*—i.e. top-to-bottom, left-to-right.]
4. Each number that is machine-read will (and should) be between one and fifteen inclusive (except for the thirteenth number already mentioned above). To get the actual numbers on the card a little arithmetic has to be done. For the first five numbers in column one nothing has to be done or alternatively add zero to each column one number. The next five (in column two, 6th–10th) require adding fifteen to each number to obtain the corresponding actual card number. In the third set of five numbers (in column three) add thirty to each machine-read number. Likewise add forty-five to each of the fourth (column four) set of five machine-read numbers to get the desired card figures. Finally add sixty to each of the last (column five) set of five machine-read numbers to record the correct readings. As an illustration, FIGS. 19*b* and 19*c* depict actual sample figures on a card (FIG. 19*b*) and the corresponding pseudo-modulo fifteen numbers which are encoded on the card (shown in FIG. 19*c*) for machine reading.
5. Using I/O Address 8FH output data FFH to reset card reader.

DISPLAY ALL SCREENS PROCEDURE

Figure 5:
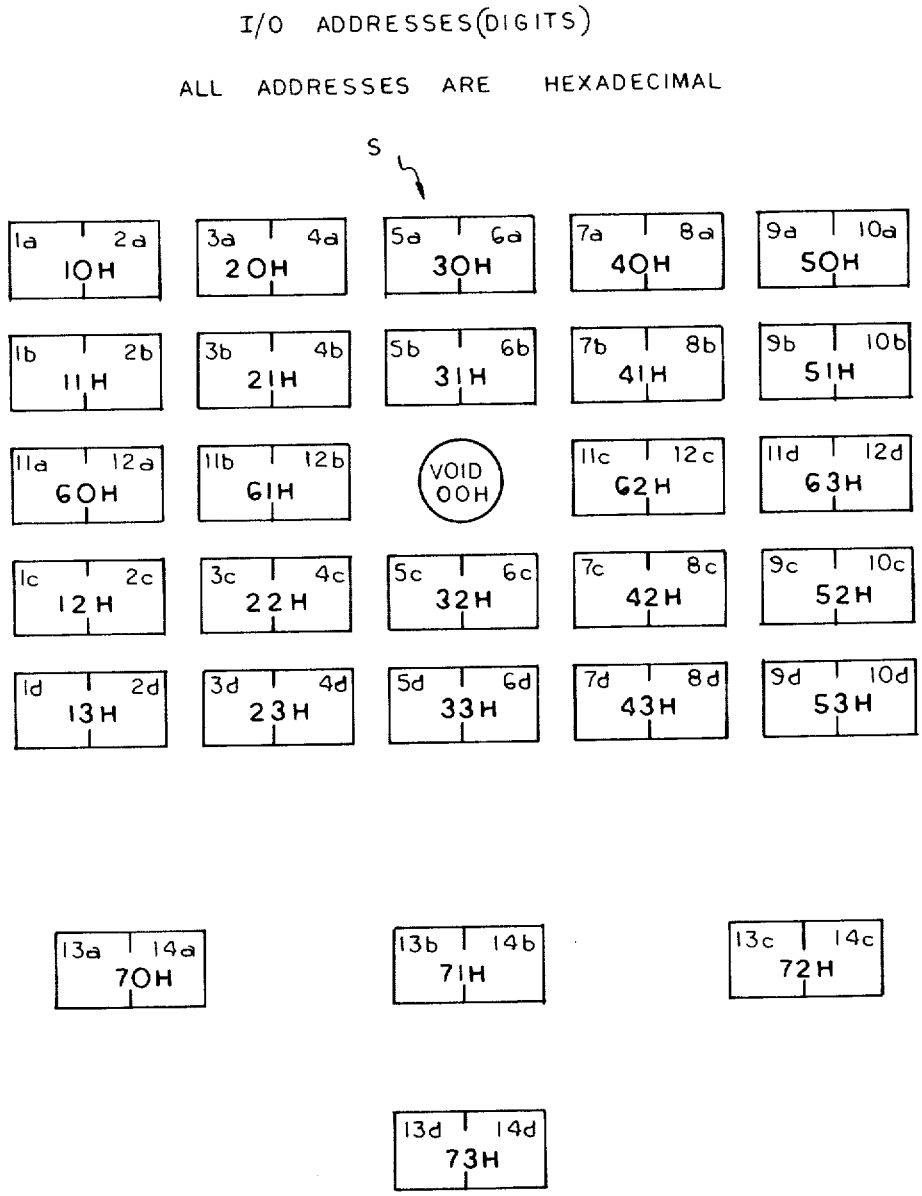
FIG. 5 shows one possible layout of the numeric display together with a sample I/O address assignment (in hexadecimal notation).
Figure 7:
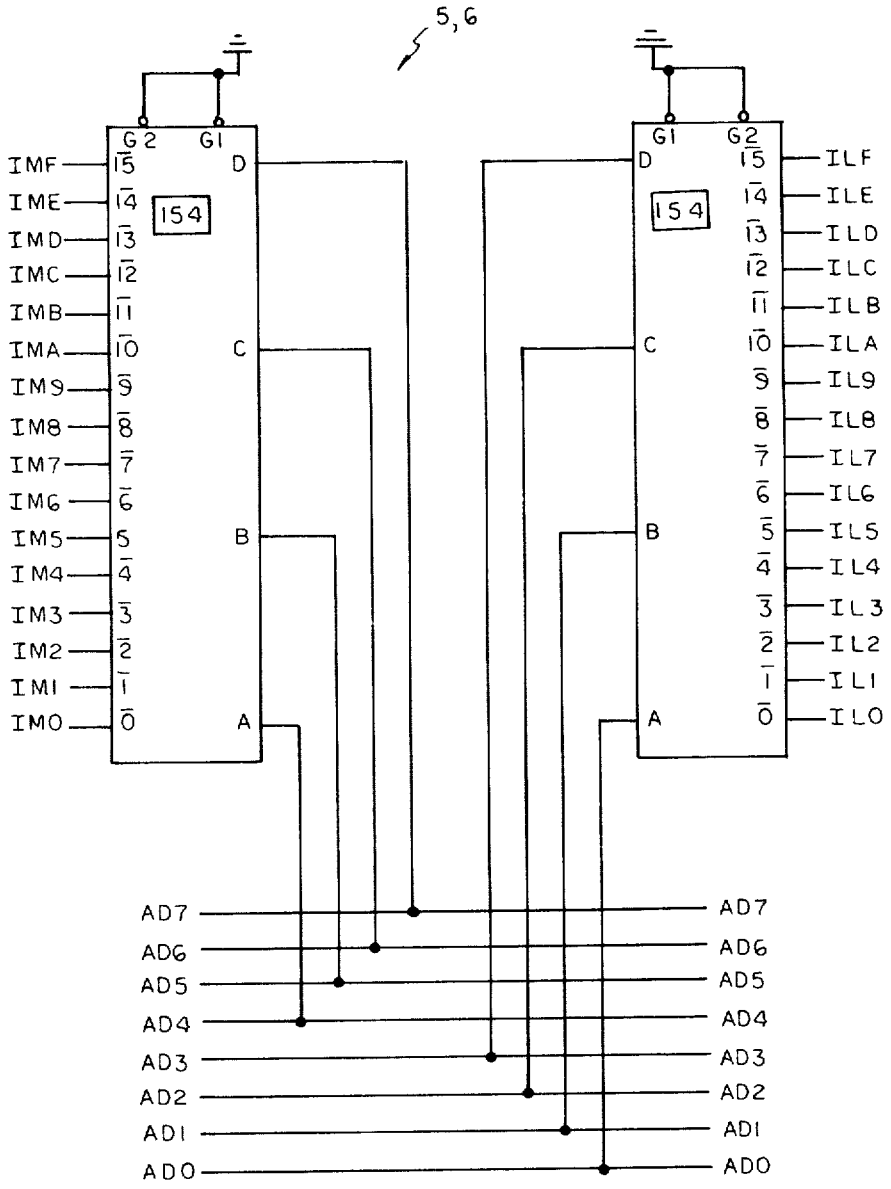
FIG. 7 is a schematic of the main I/O address decoder circuitry.
Figure 8:
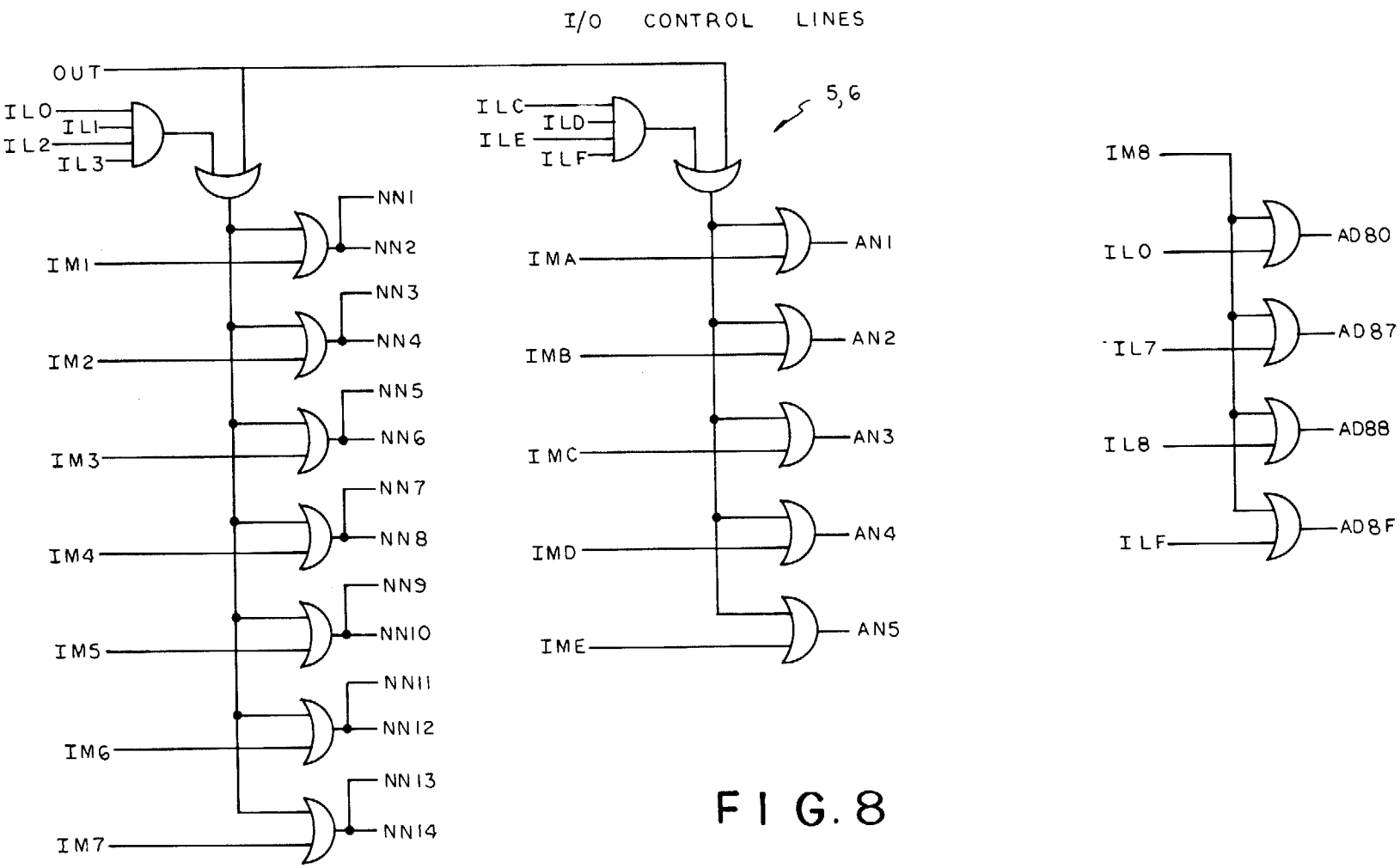
FIG. 8 is a schematic of the I/O control circuitry.
Figure 9:
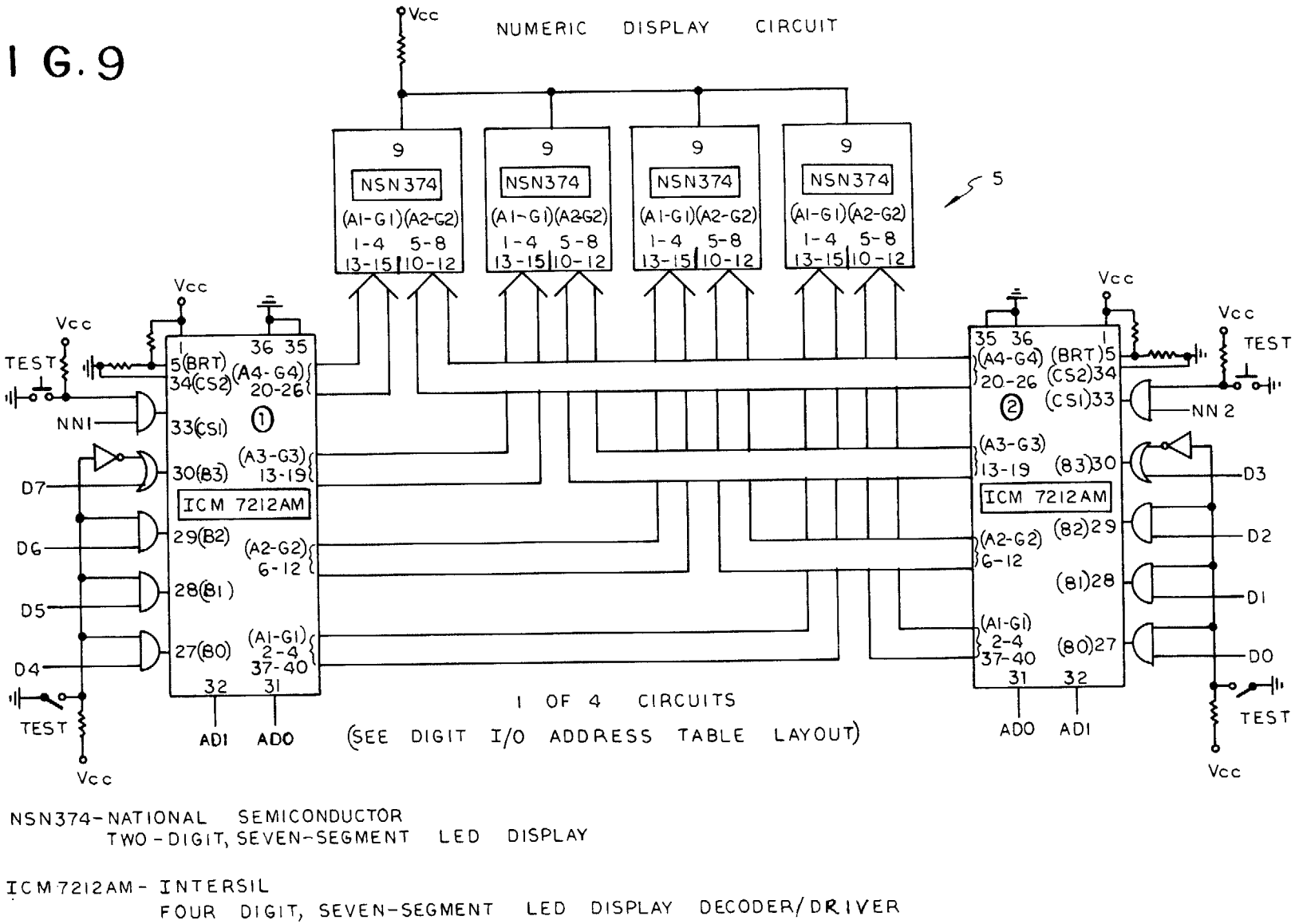
FIG. 9 illustrates a sample numeric display circuitry.
Figure 10:
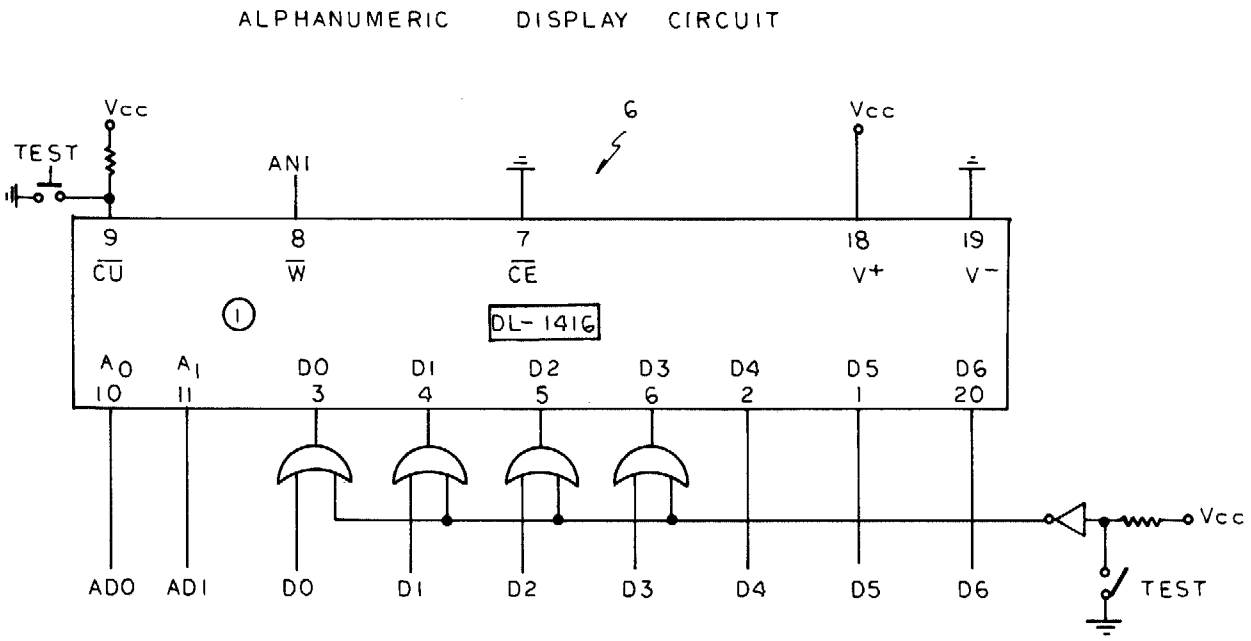
FIG. 10 illustrates a sample alphanumeric display circuitry.

To display a digit or character the processor simply outputs the desired data using the I/O address of the intended display. Each character in the alphanumeric display 6 is individually addressable but the components of the numeric display 5 are addressable in pairs. The numeric I/O address table is shown in FIG. 5 and the alphanumeric I/O address table together with other relevant I/O addresses appears in FIG. 6. All addresses are in hexadecimal (H). The numeric display accepts binary coded decimel (BCD) data only while the alphanumeric display accepts ASCII data only. Hardware Realization A representative two-dimensional, diagrammatic layout of the whole devide 1 appears in FIG. 1 and includes a card-input assembly 8 and 31, a numeric display 5 comprising sub-displays 11–15, an alphanumeric display 6, a switch matrix 7 consisting of control buttons 16–22, 25 and 26, a numeric pad 23 and a pattern-input array 24, and an optional audio module 9. The ON/-OFF switch 32 controls the power supply which may come from a battery pack or household outlet. A reset button 33 (not shown) allows the on-board programmable controller to be reset manually.

Figure 2:
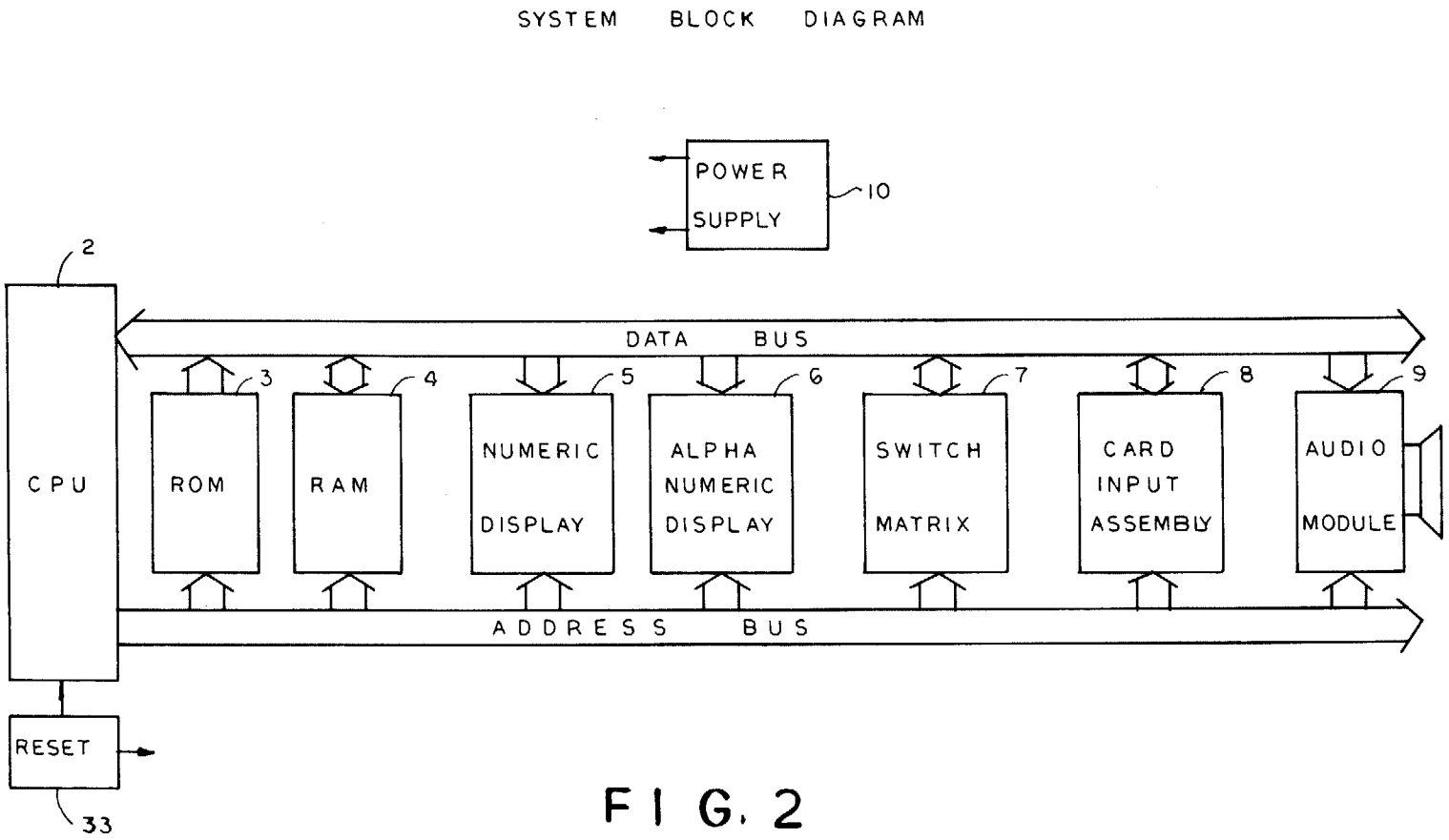
FIG. 2 is a block diagram depicting one of several possible interconnections between the various subassemblies constituting the system. This particular arrangement includes a programmable control element labelled CPU.

The block diagram shown in FIG. 2 depicts the major system subassemblies and their interconnection. The operation of the device is supervised by the master controller 2. The controlling program resides in ROM 3 while RAM 4 is used to store temporary data such as numbers read from a card. The numeric display 5 is used by the device to display numeric data such as winning cards while helpful messages intended for the player appear on alphanumeric display 6, as appropriate. The optional audio module 9 informs the player by means of appropriate sounds when a special event such as a win (or "BINGO") occurs.

All player-initiated communications between the player and the device take place by means of the card-input assembly 8 and 31 and the switch matrix 7. The latter has three major components: control buttons 16–22, a numeric pad 23 and a pattern-input array 24 together with the two associated control buttons 25 and 26.

Figure 11:
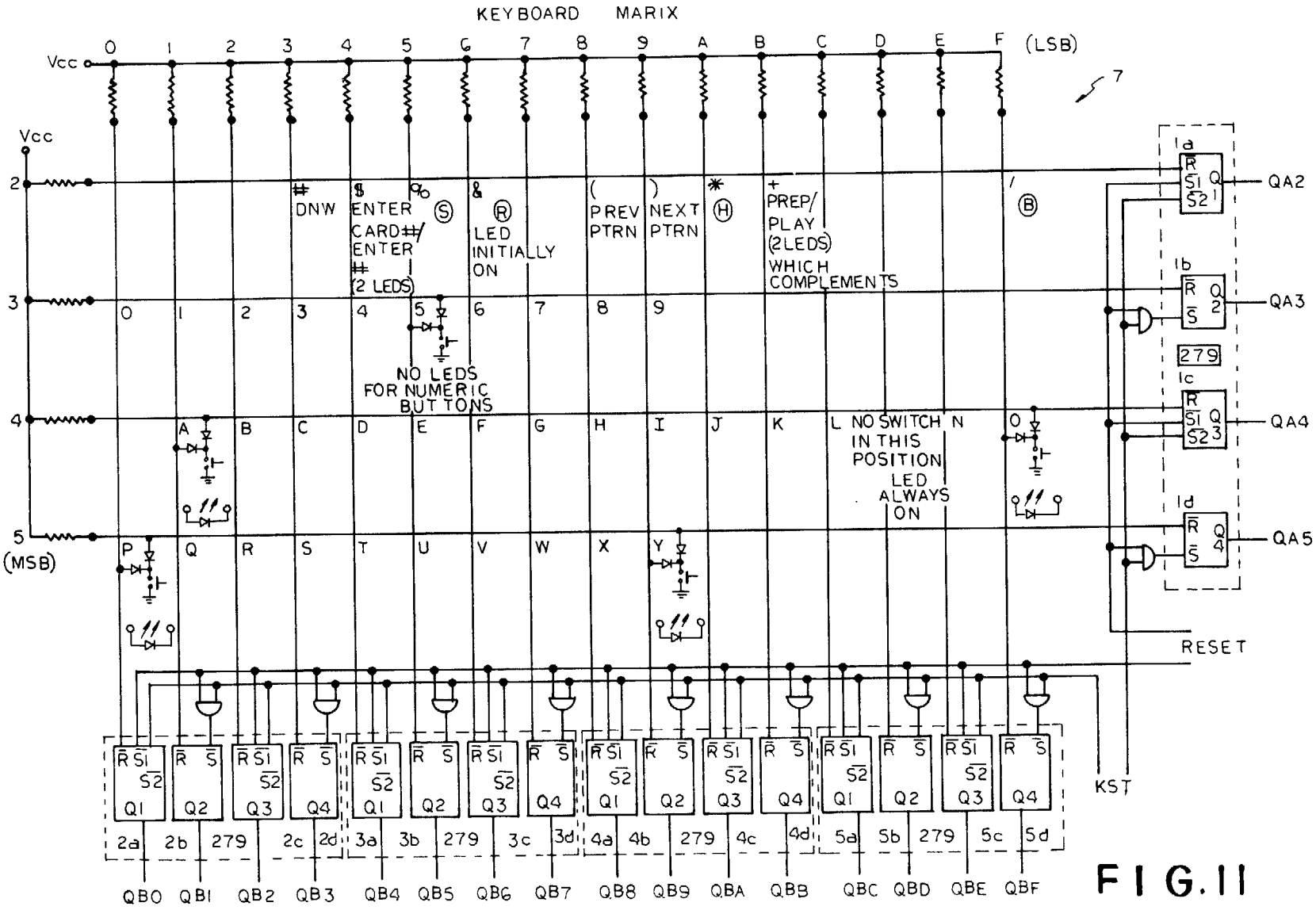
FIG. 11 shows the keyboard circuit layout.
Figure 12:
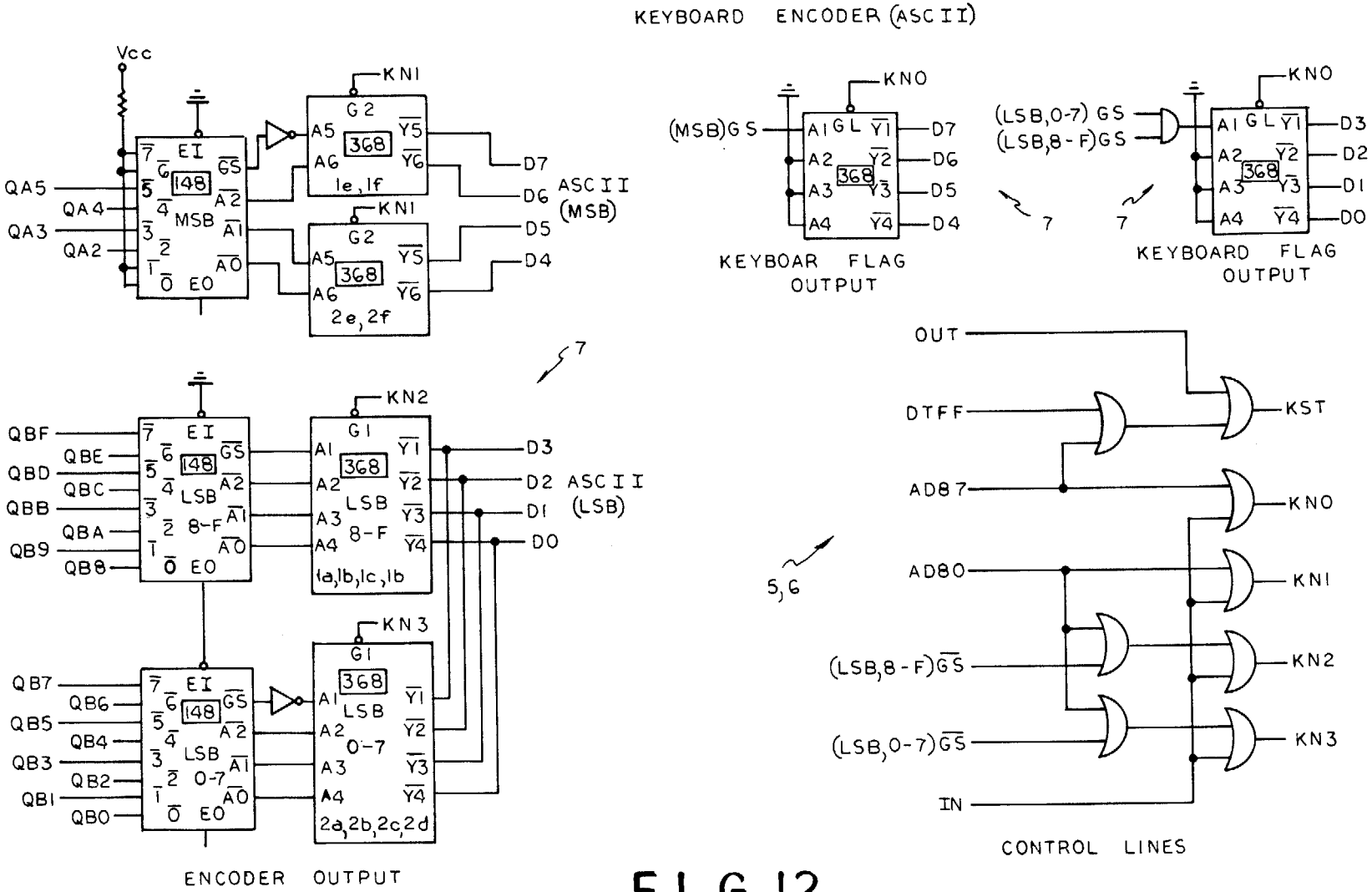
FIG. 12 is a schematic of the keyboard output and control circuits.

Each button in the switch matrix 7 when pushed outputs an eight-bit ASCII code with the eighth (most significant) bit set to zero. The array is realized here using standard 7400 series (or equivalent) integrated circuits, as shown in FIGS. 11 and 12. With reference to FIG. 11, when a button (not all buttons are shown) is pushed two flip-flops are reset. One flip-flop is associated with the four most significant bits of the corresponding ASCII code while the other flip-flop determines the four least significant bits of the same code. The output of each flip-flop is converted to the appropriate binary code by means of an eight-to-three priority encoder. The outputs of the encoders are next inverted by three-state inverters whose outputs are tied to the data bus. Whenever a button is pushed the Keyboard Flag is also set to indicate "key down" as depicted in FIG. 12. The controller first reads the flag. If the flag is set (indicated by the presence of data FFH) then it next reads the ASCII data.

Figure 13:
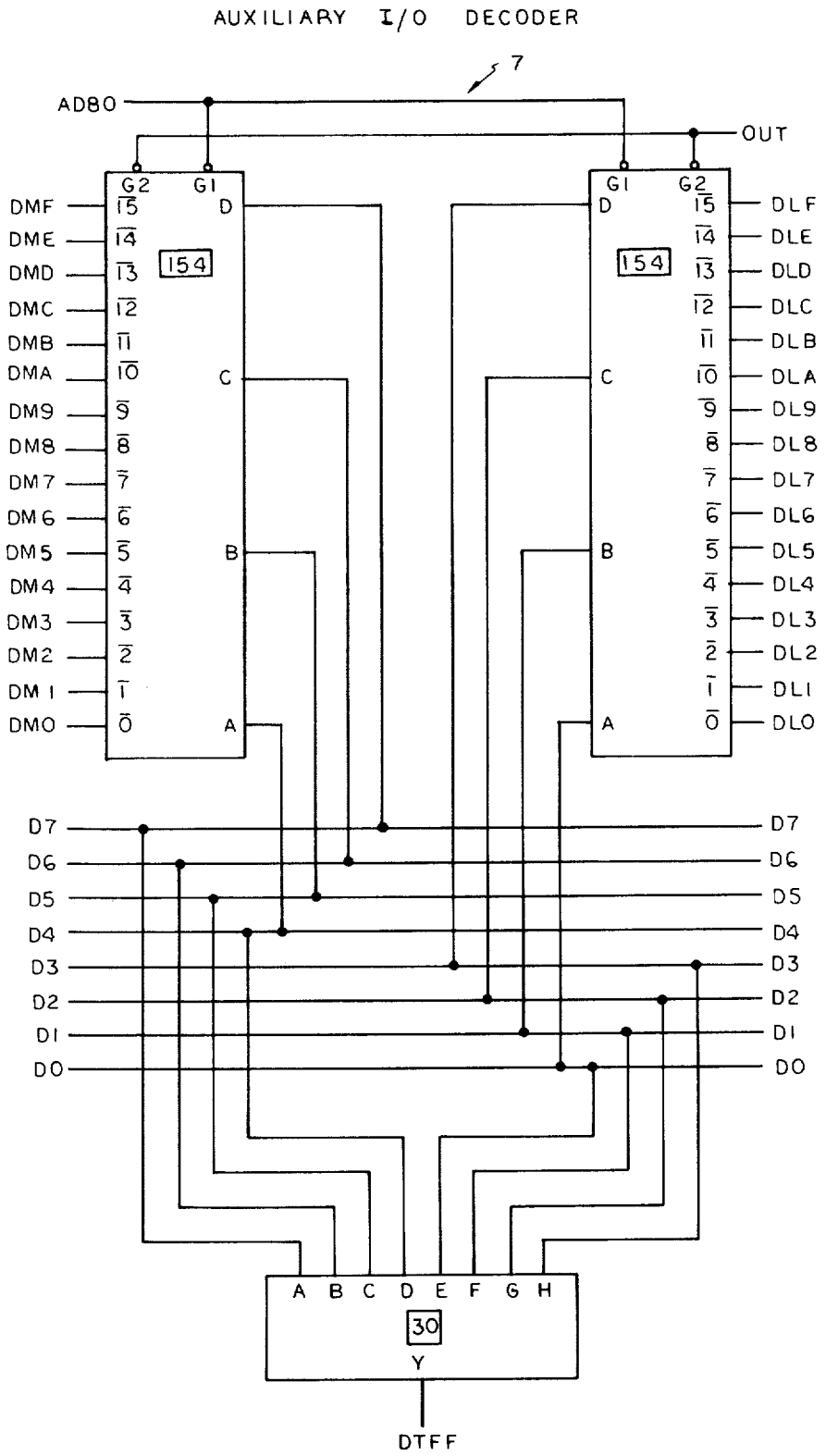
FIG. 13 depicts the auxilliary decoder circuitry associated with the pattern-input matrix.
Figure 14A:
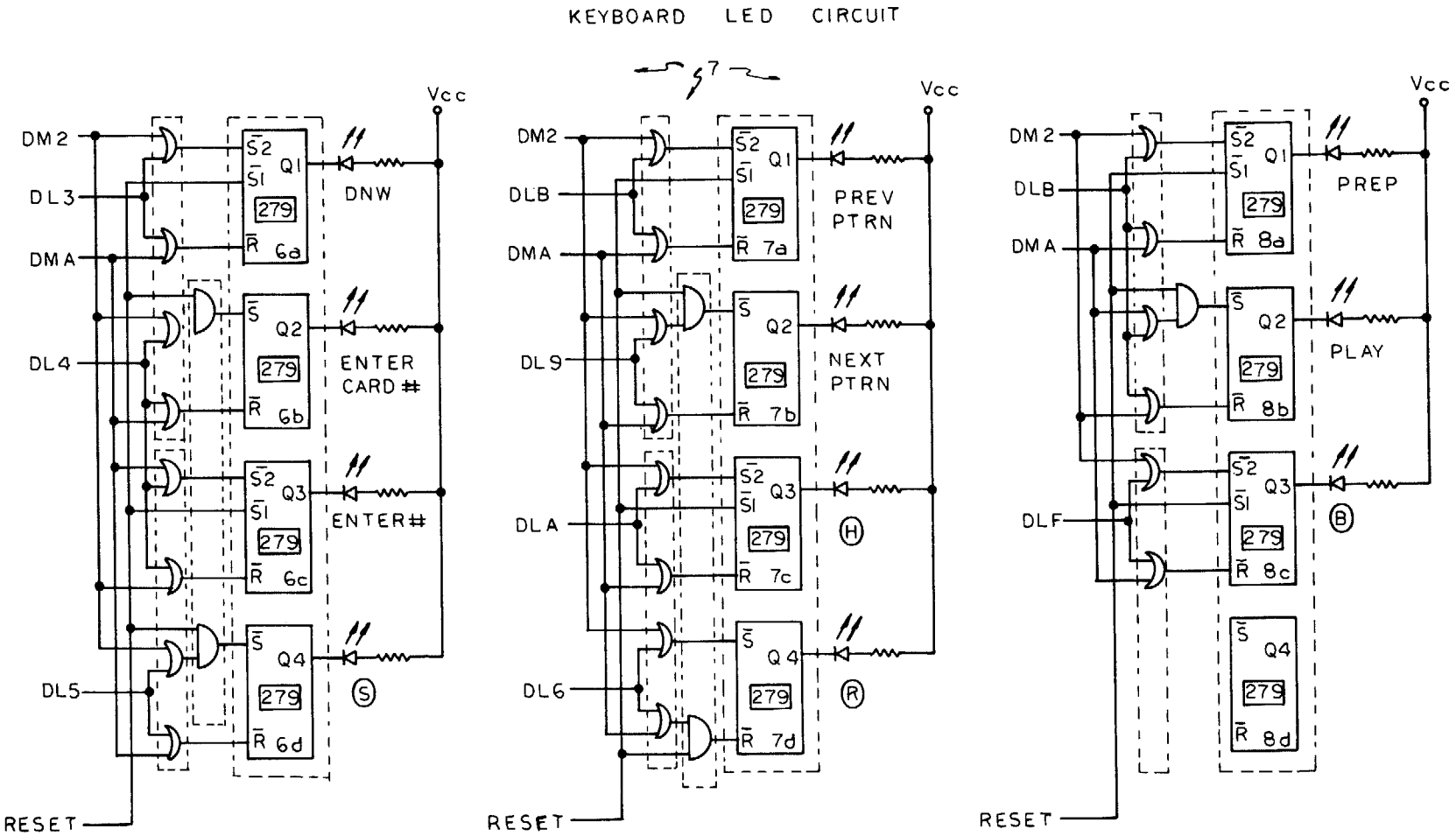
FIGS. 14*a*, 14*b*, 14*c* and 14*d* illustrate the LED circuits associated with the keyboard.
Figure 14B:
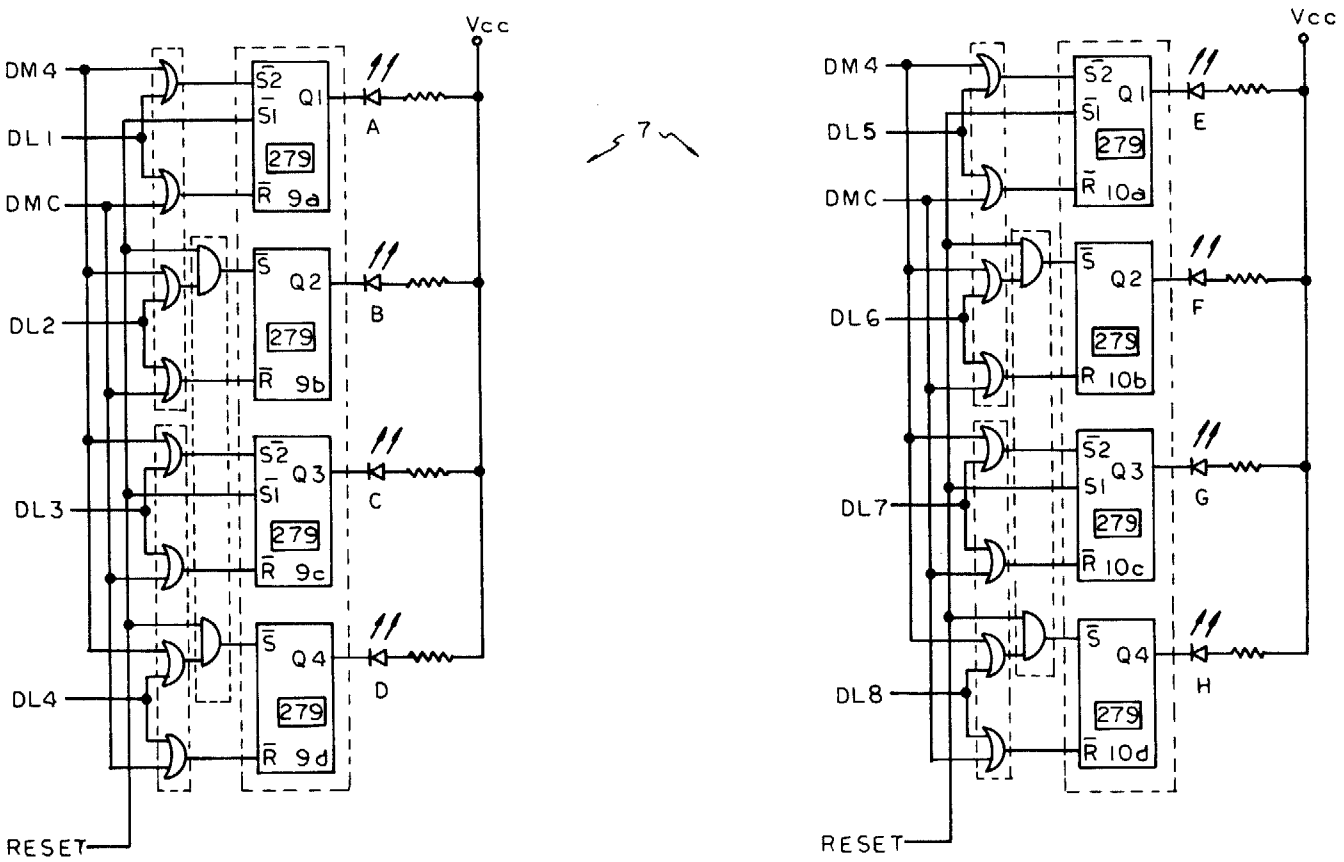
Figure 14C:
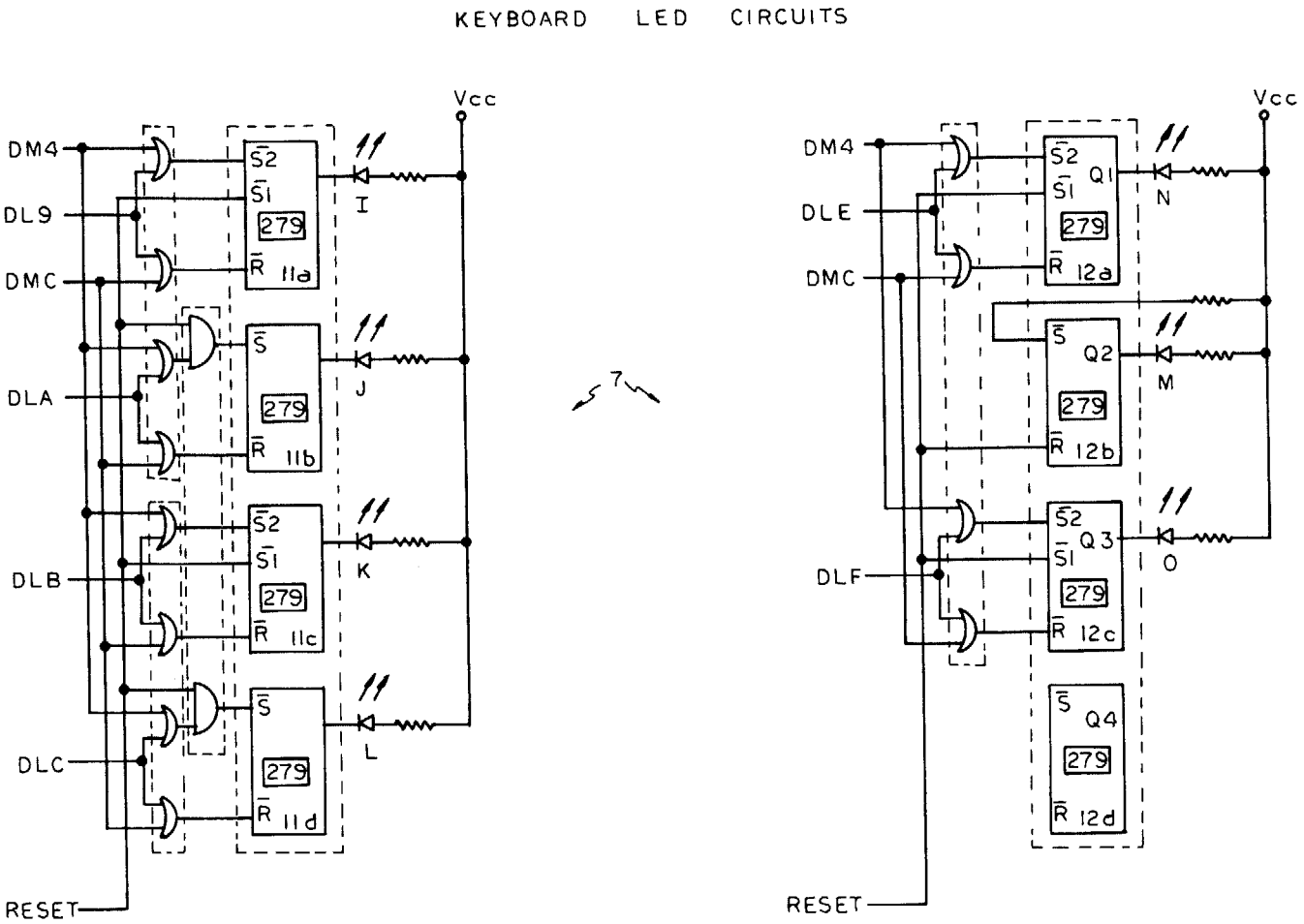
Figure 14D:
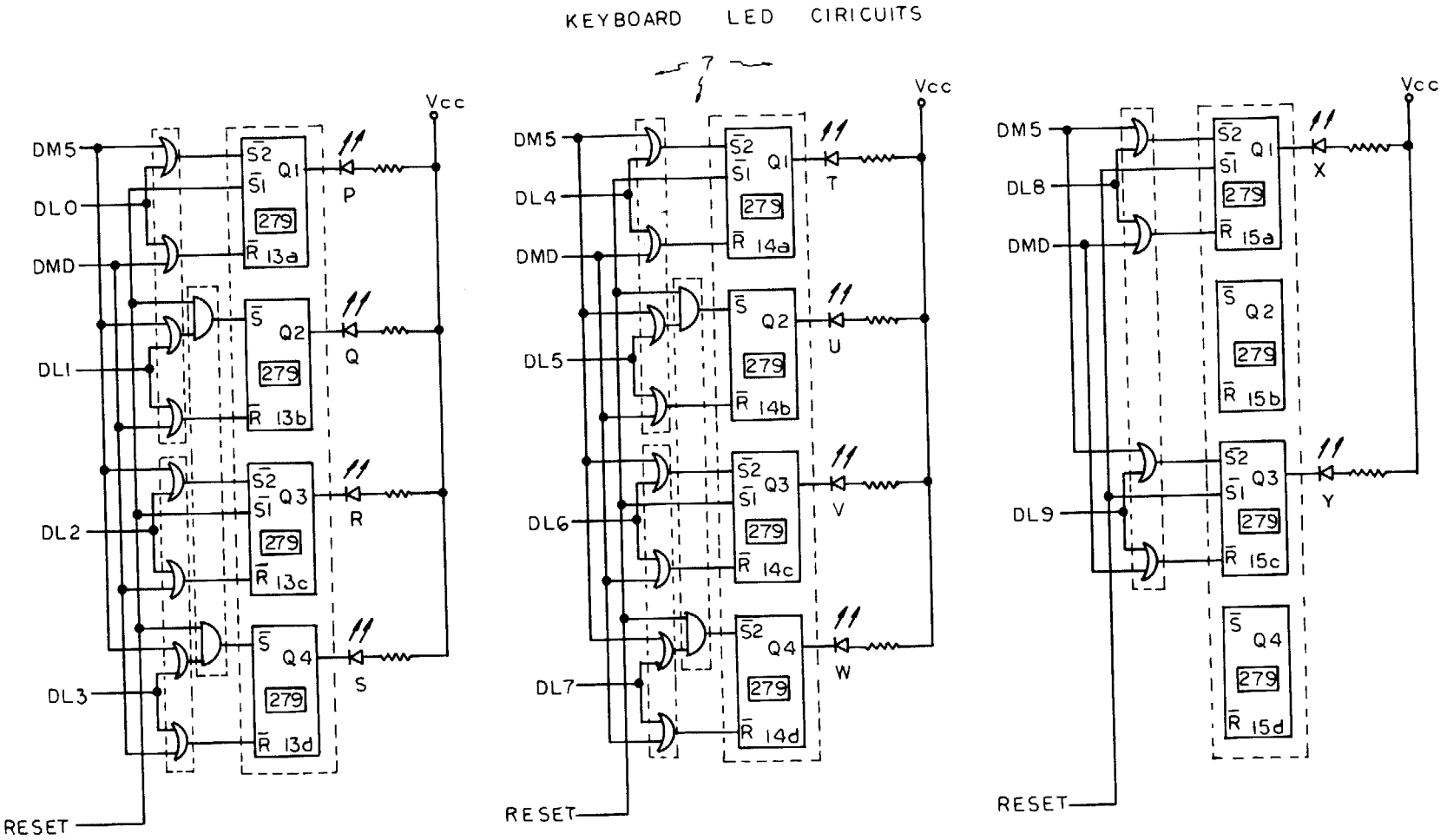

Some of the buttons in the switch matrix 7 have LEDs associated with them. The LED circuitry is detailed in FIGS. 13, 14*a*, 14*b*, 14*c* and 14*d*. Each button when pushed outputs a unique eight-bit ASCII code, as outlined above. To turn off the LED associated with a particular button therefore, the controller sends the selfsame eight-bit ASCII code associated with that button addressing the data to the keyboard. The same technique is used to turn on the LED except that the eighth (most significant) bit of the codeword is set to one. Each such codeword is decoded by the circuitry of FIG. 13 the output lines being combined appropriately to set or reset the various flip-flops in FIGS. 14*a*–14*d* and hence turn off or on the associated LEDs, as desired.

The circuitry of the card-input assembly 8 and 31 appears in FIGS. 15*a*, 15*b*, 16, 17*a*, 17*b* and 17*c*. The controller must first read the card reader flag, the circuitry of which appears in FIG. 15*b*. With reference to the latter figure when the card is secured on the reader assembly (securing mechanism and associated switches not shown) continuity is established at points indicated in the diagram (FIG. 15*b*). Then on pushing control button 31 (shown in FIGS. 1 and 15*b*) the flag is set, as evident from FIG. 15*b*, indicating to the processor that a card is aligned on the reader.

Figure 16:
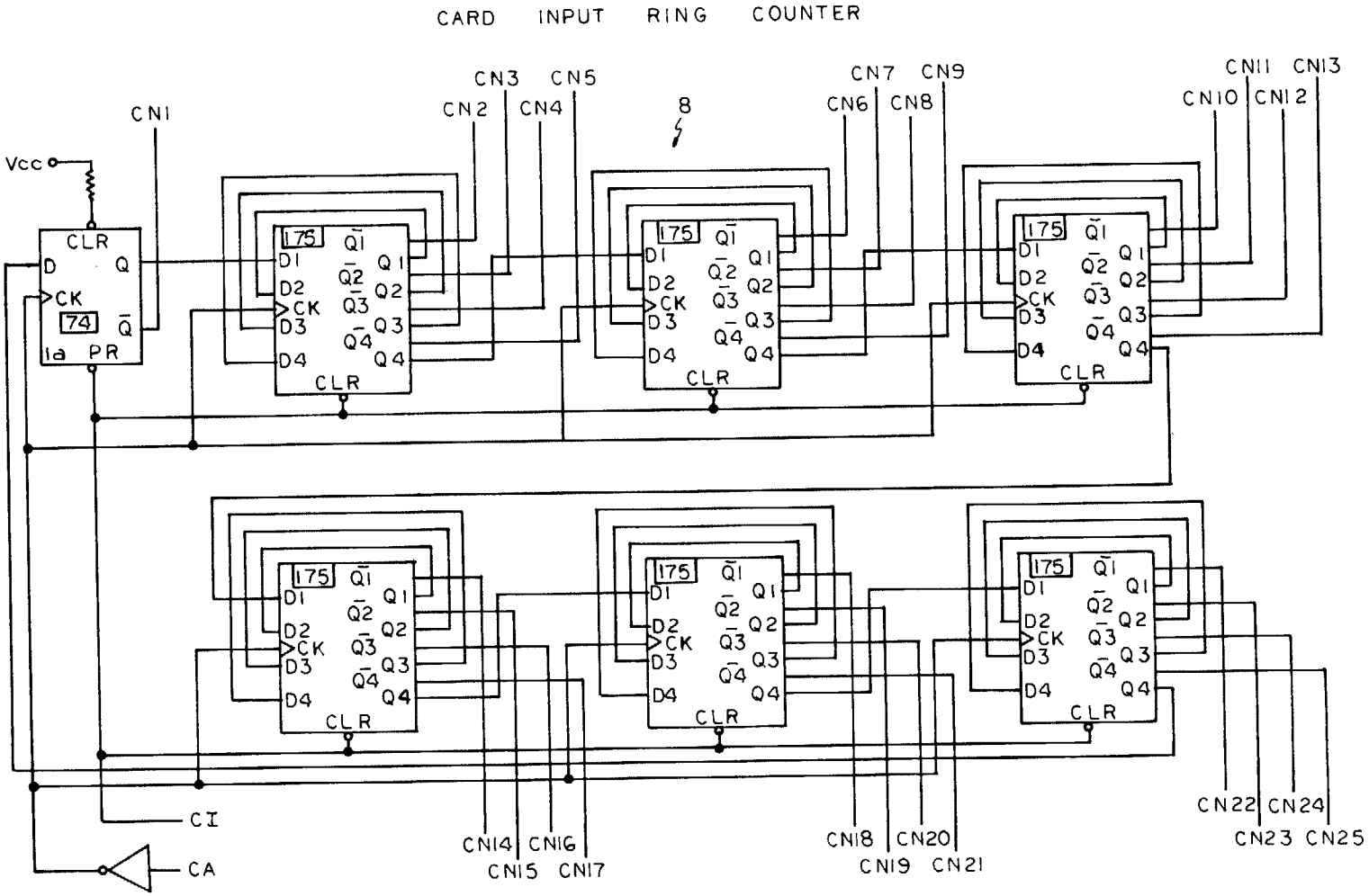
FIG. 16 is a schematic of the card reader ring counter circuit.

The processor reads the numbers on the card sequentially with the aid of the ring counter shown schematically in FIG. 16. Each time the processor attempts to read the card-input flag the ring counter is reset is indicated by the control lines in FIGS. 15*a*, 15*b* and 16. Thus initially the first number on the card is set to be read. After reading each number the processor sends data FFH addressed to the card reader in order to advance the ring counter, and hence the reader, to the next number. The reading process continues until all twenty-five numbers on the card have been read. The thirteenth number to be read is always zero. After reading all the numbers the processor next sends data FFH addressed to the card-input flag in order to reset that flag.

Figure 17A:
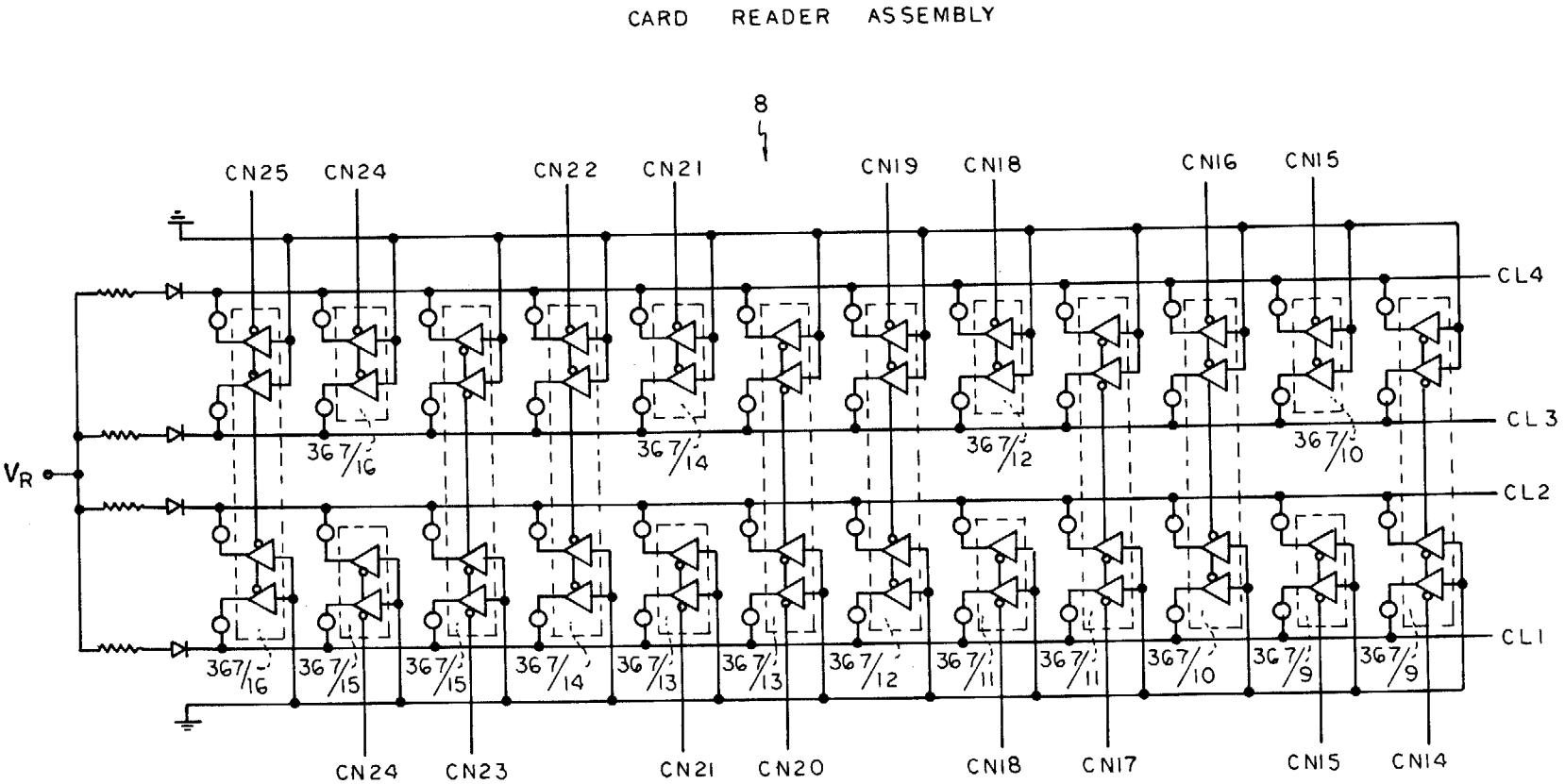
FIGS. 17*a*, 17*b* and 17*c* illustrate one realization of the card reader sensing and output circuitry.
Figure 17B:
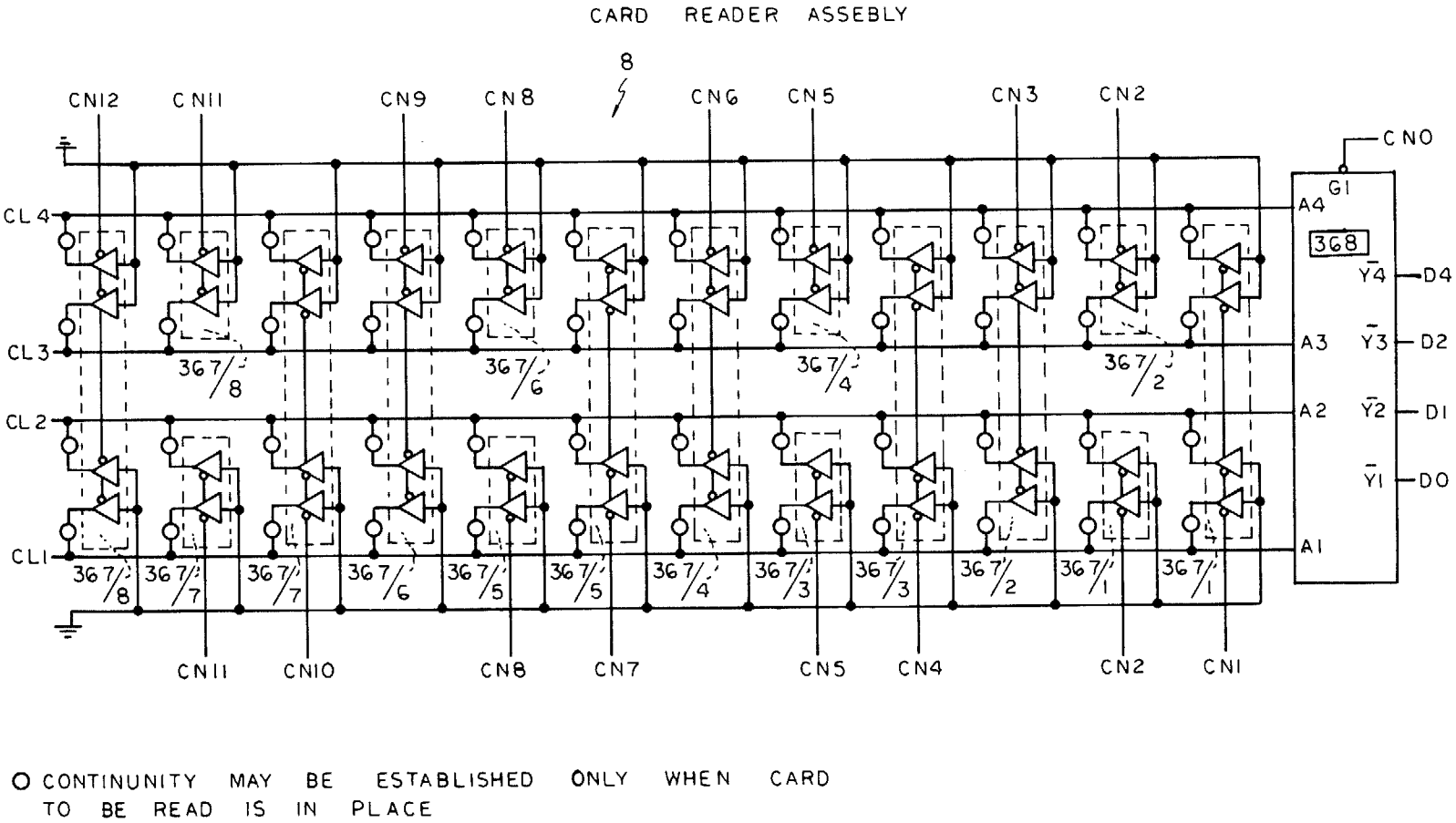
Figure 17C:
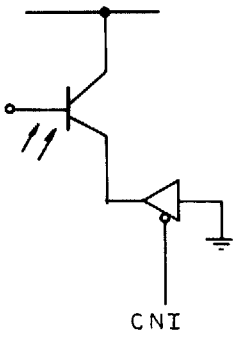
Figure 17C:
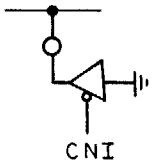
Figure 18:
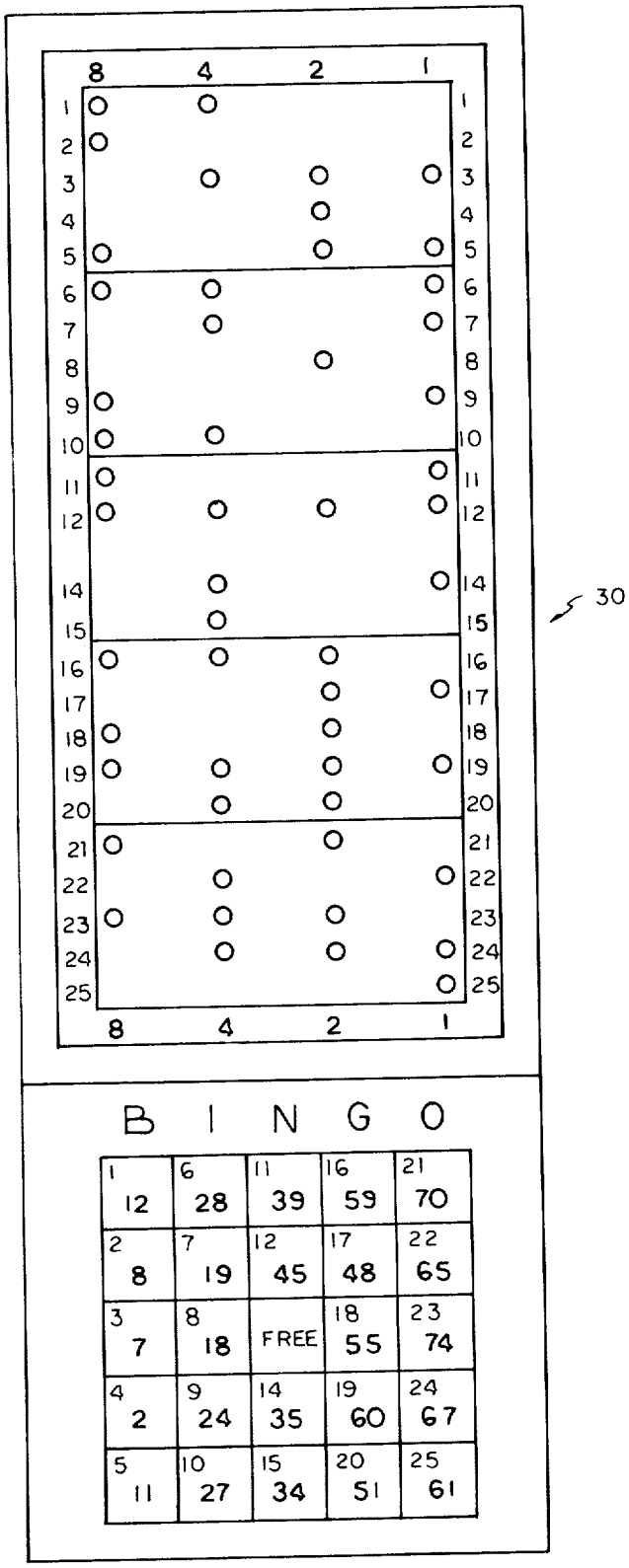
FIG. 18 illustrates one possible form of the BINGO card compatible with the card reader assembly described here.
Figure 20:
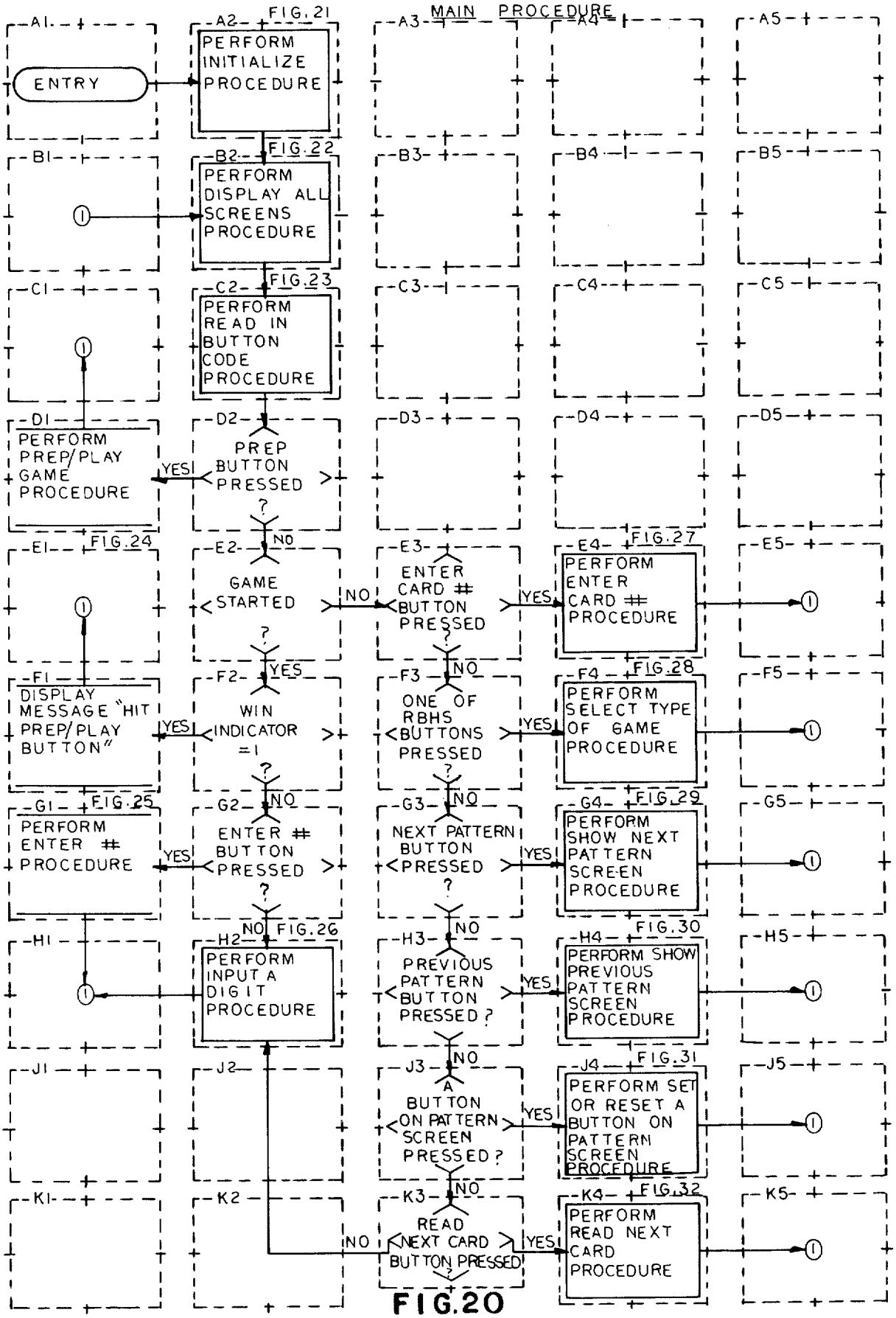
FIG. 20 represents the flowchart of the Main Procedure in the Control Program.
Figure 21:
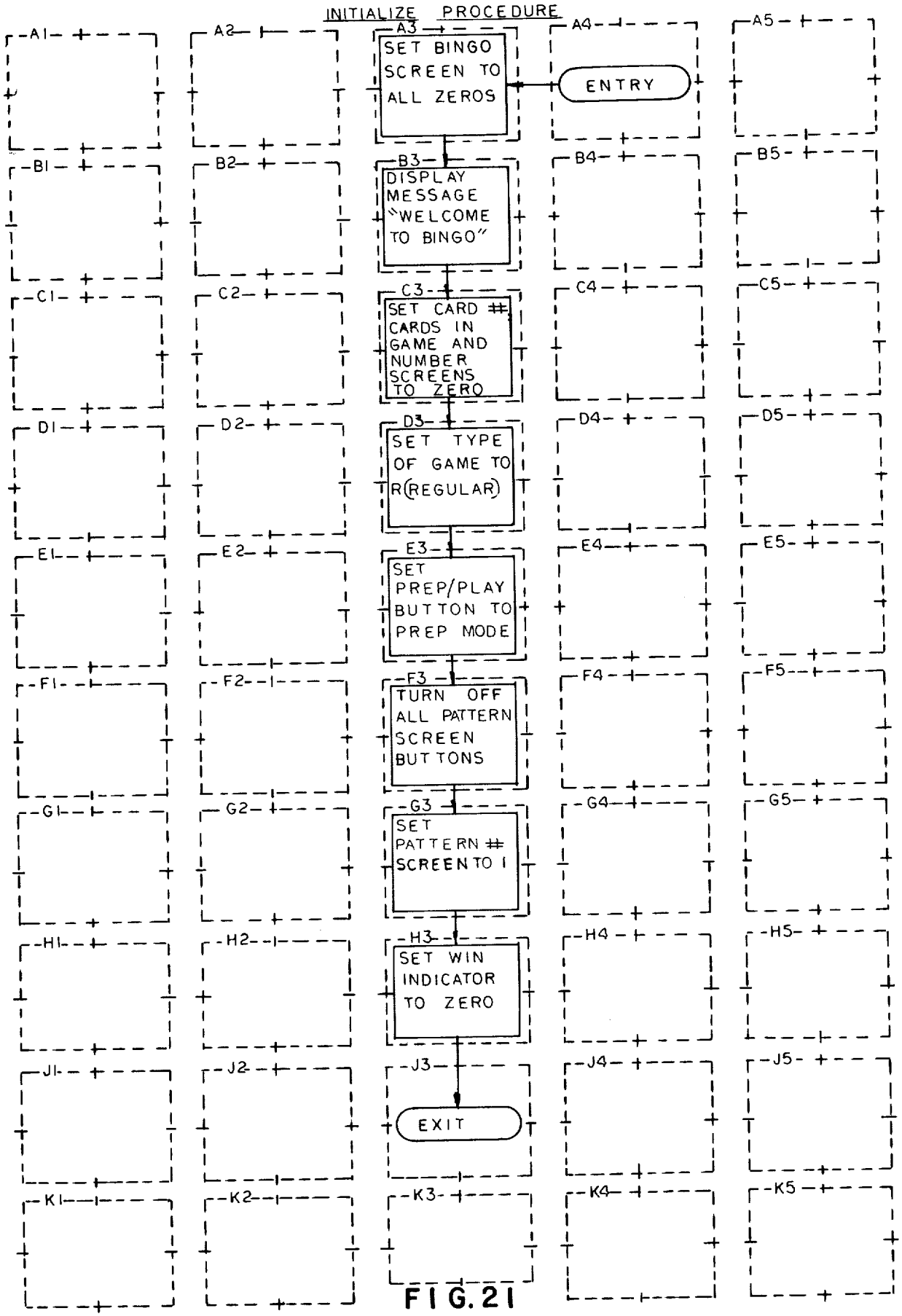
FIG. 21 is a flowchart of the Initialize Procedure
Figure 22:
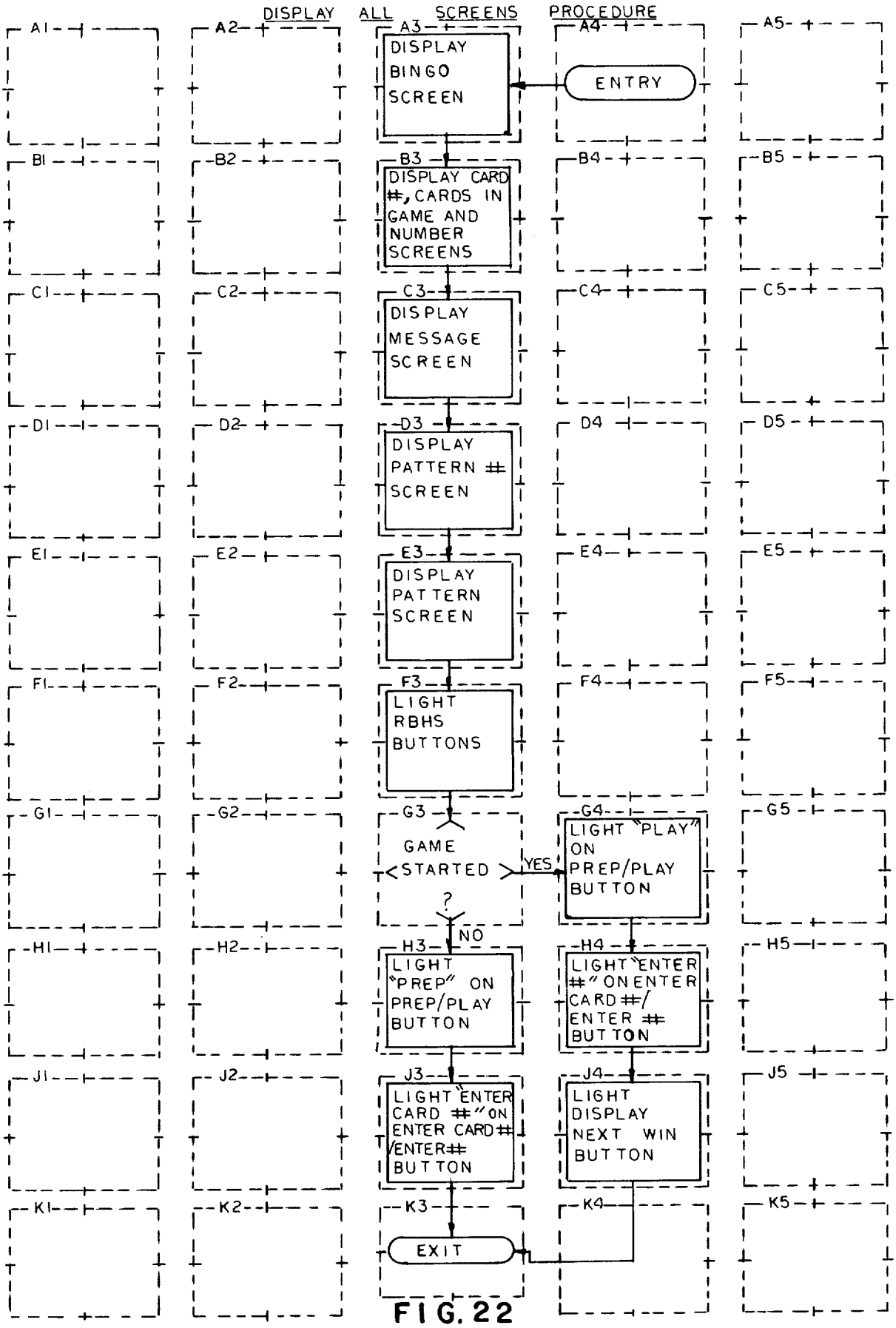
FIG. 22 represents the Display All Screens Procedure flowchart.
Figure 23:
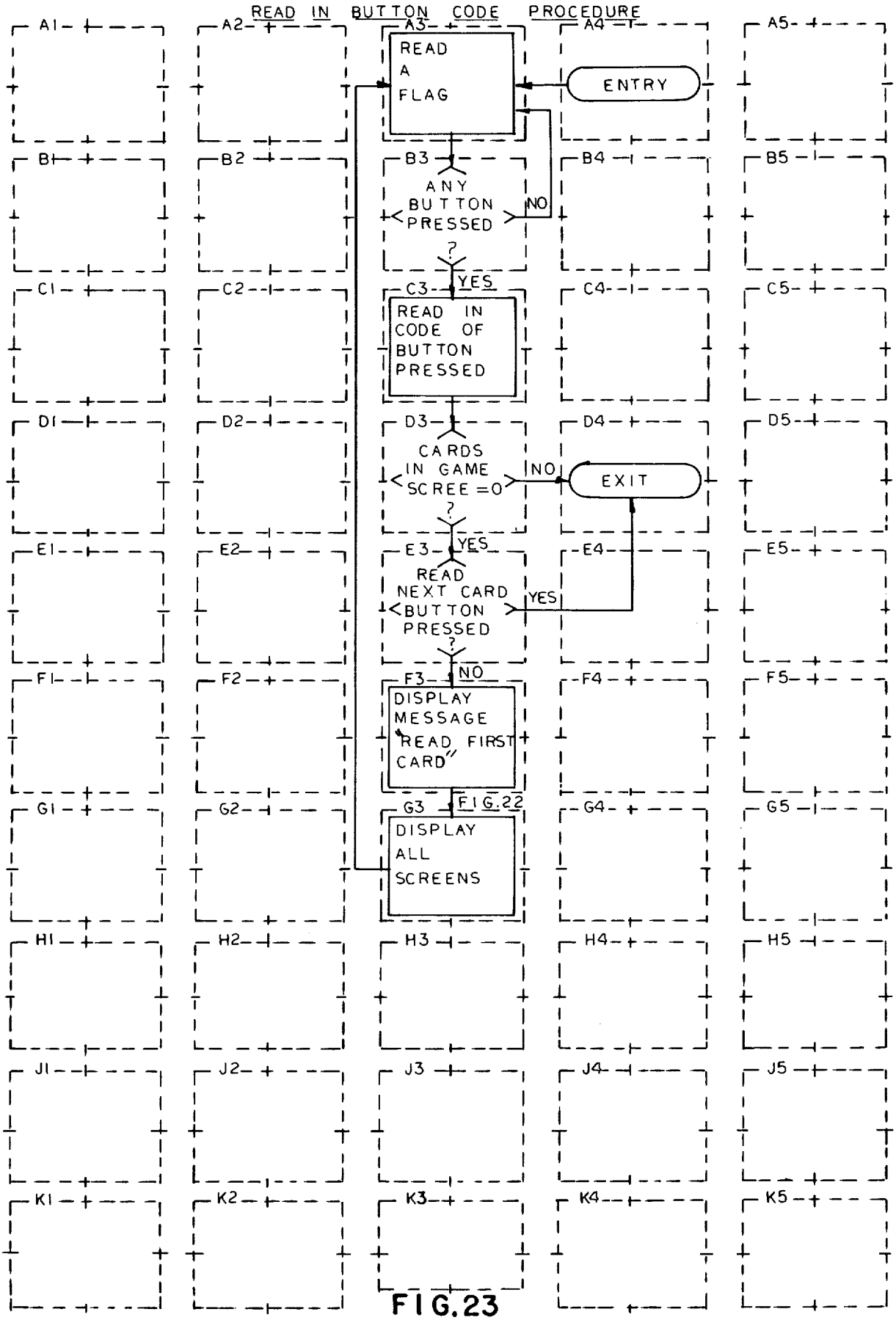
FIG. 23 depicts the Read in Button Code Procedure flowchart.
Figure 24:
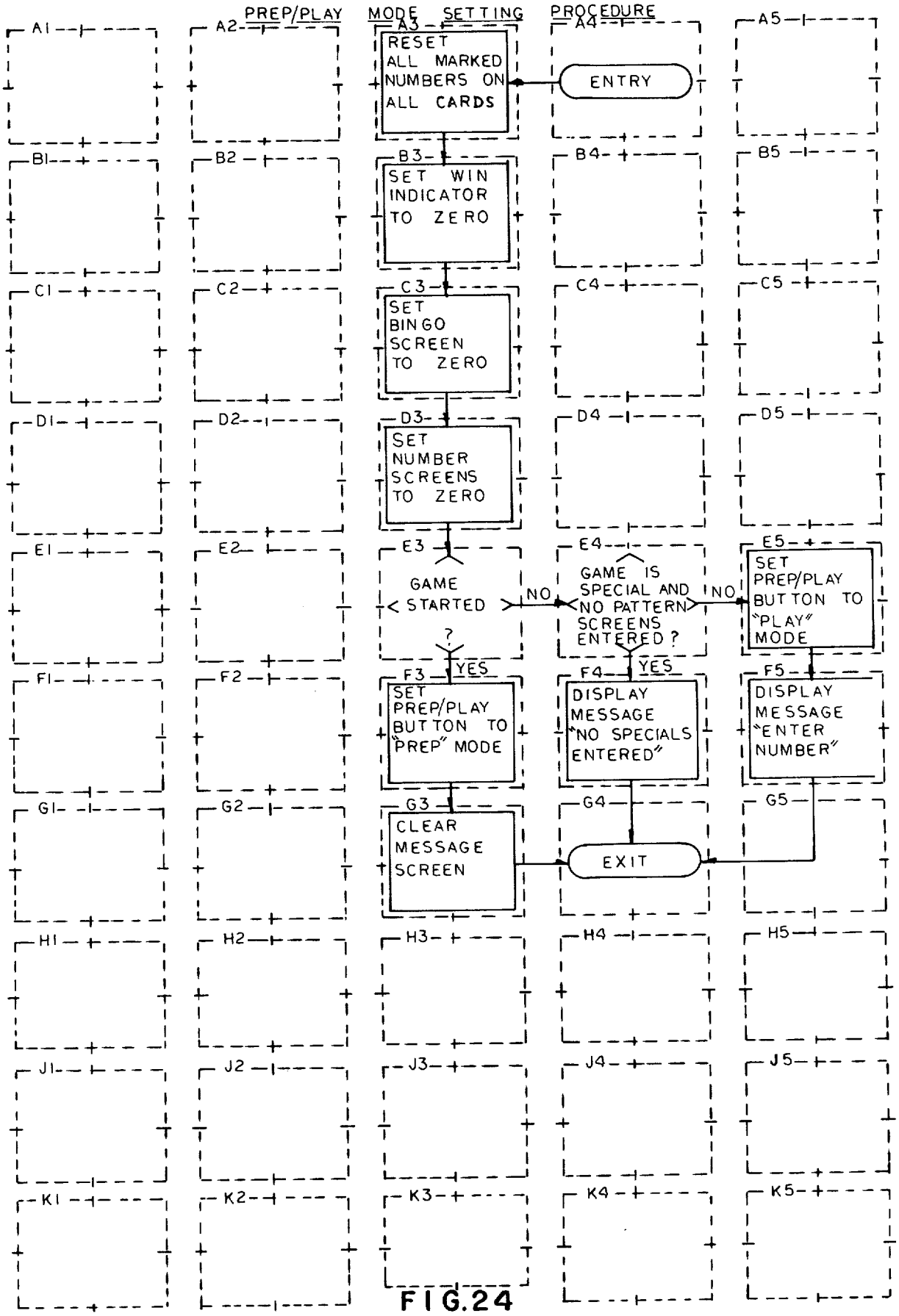
FIG. 24 is the PREP/PLAY Mode Setting Procedure flowchart.
Figure 25:
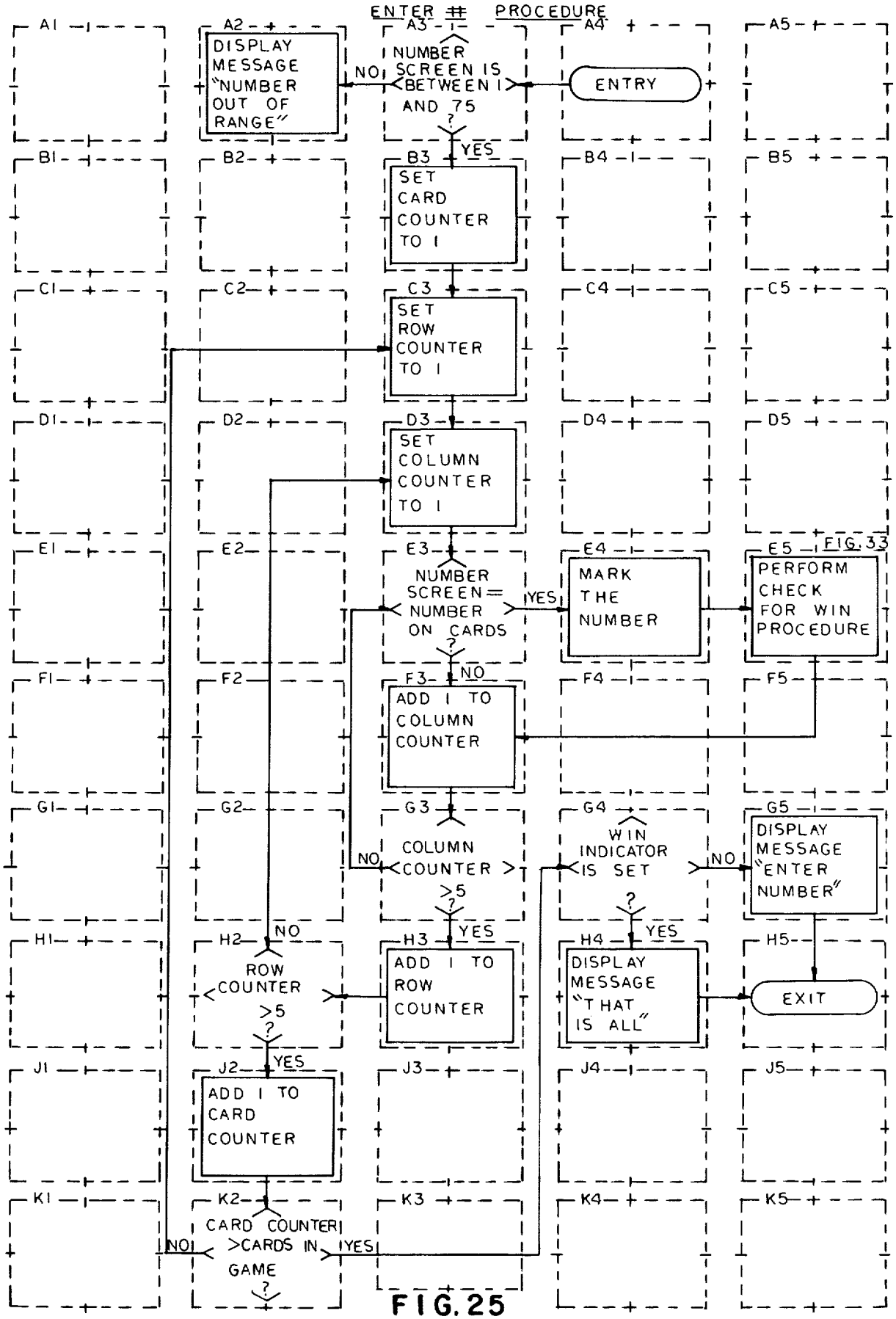
FIG. 25 is the flowchart of the ENTER # Procedure.
Figure 26:
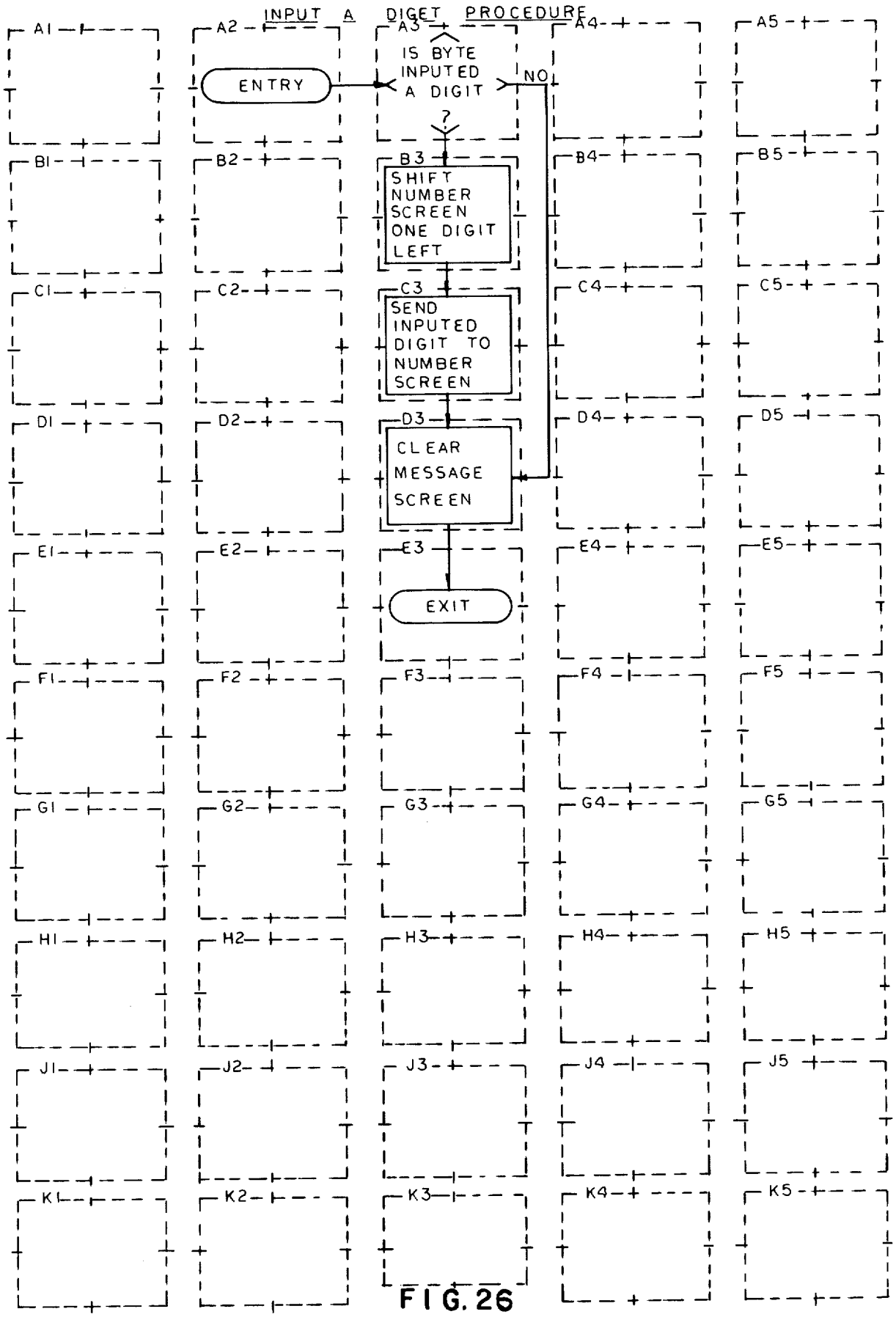
FIG. 26 shows the flowchart of the Input A Digit Procedure.
Figure 27:
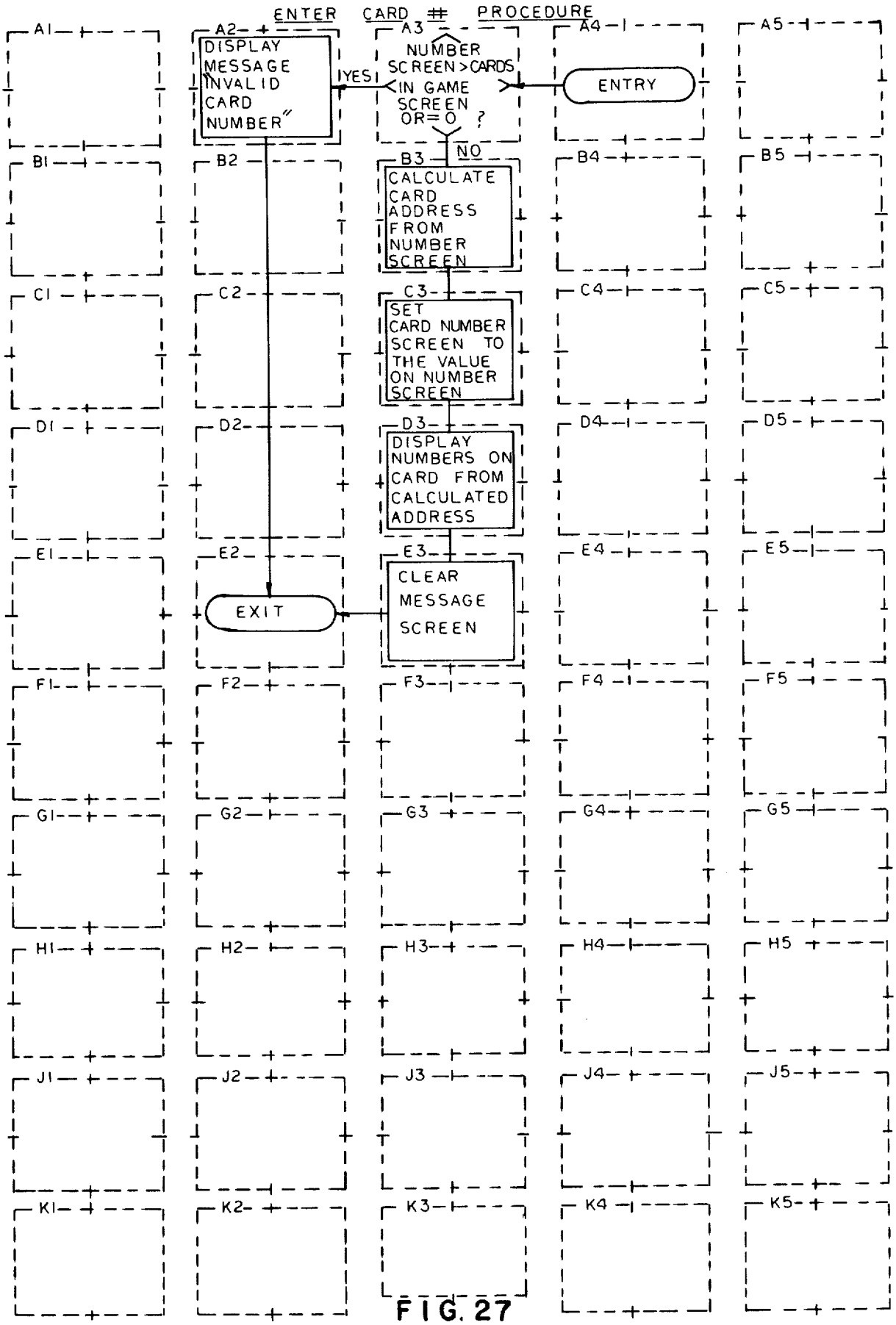
FIG. 27 represents the flowchart of the ENTER CARD # Procedure.
Figure 28:
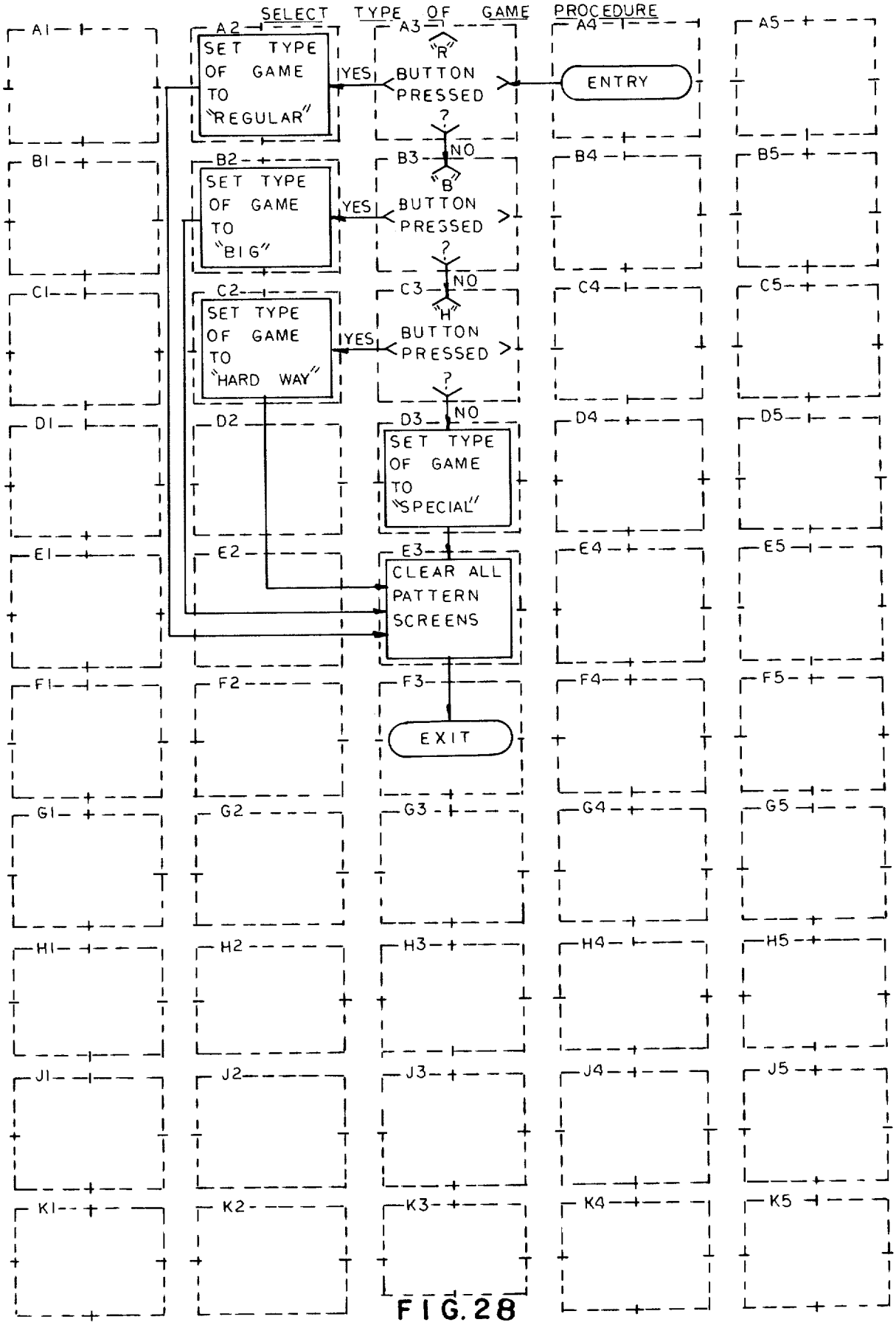
FIG. 28 depicts the flowchart of the Select Type of Game Procedure.
Figure 29:
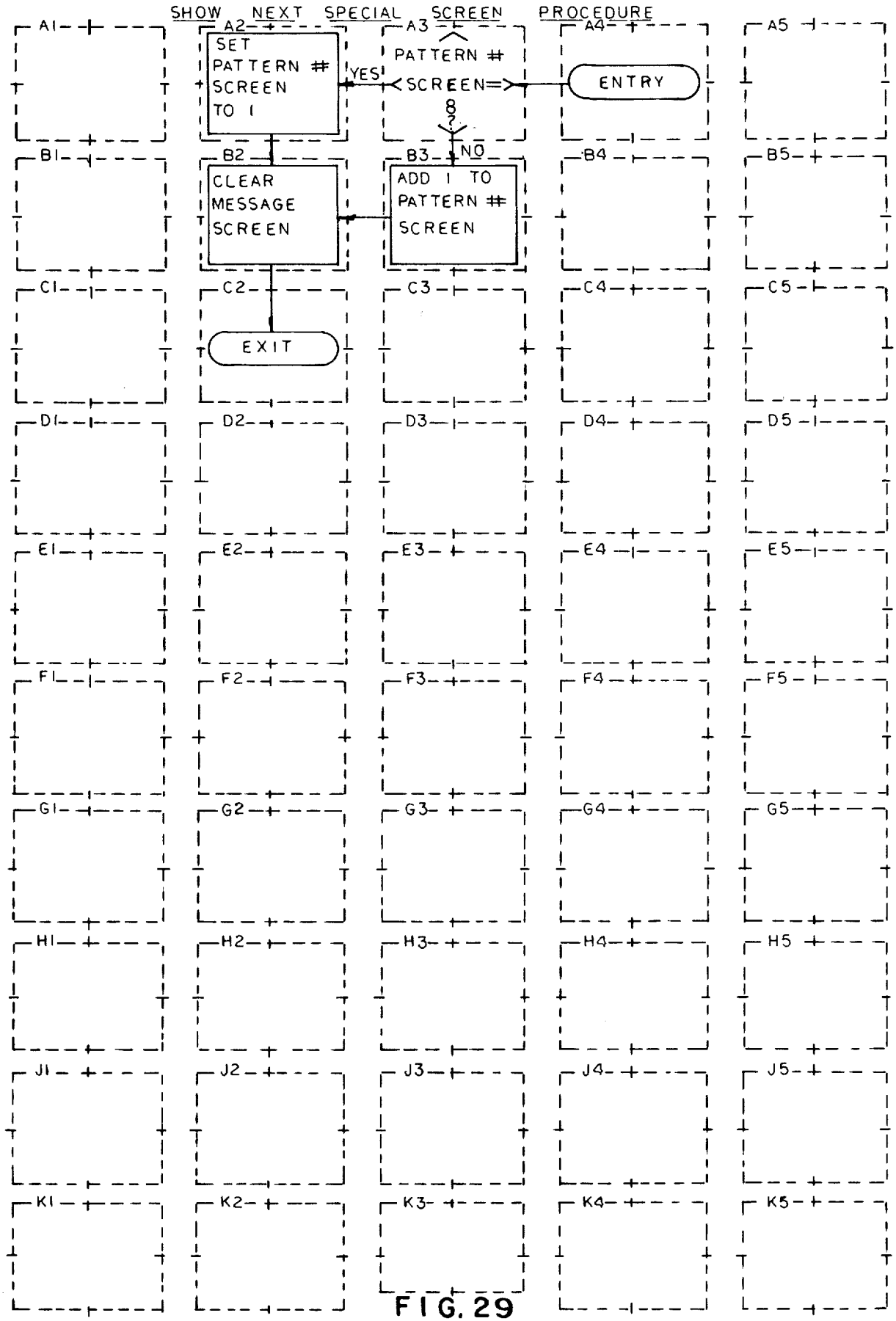
FIG. 29 is the flowchart of the Show Next Special Screen Procedure.
Figure 30:
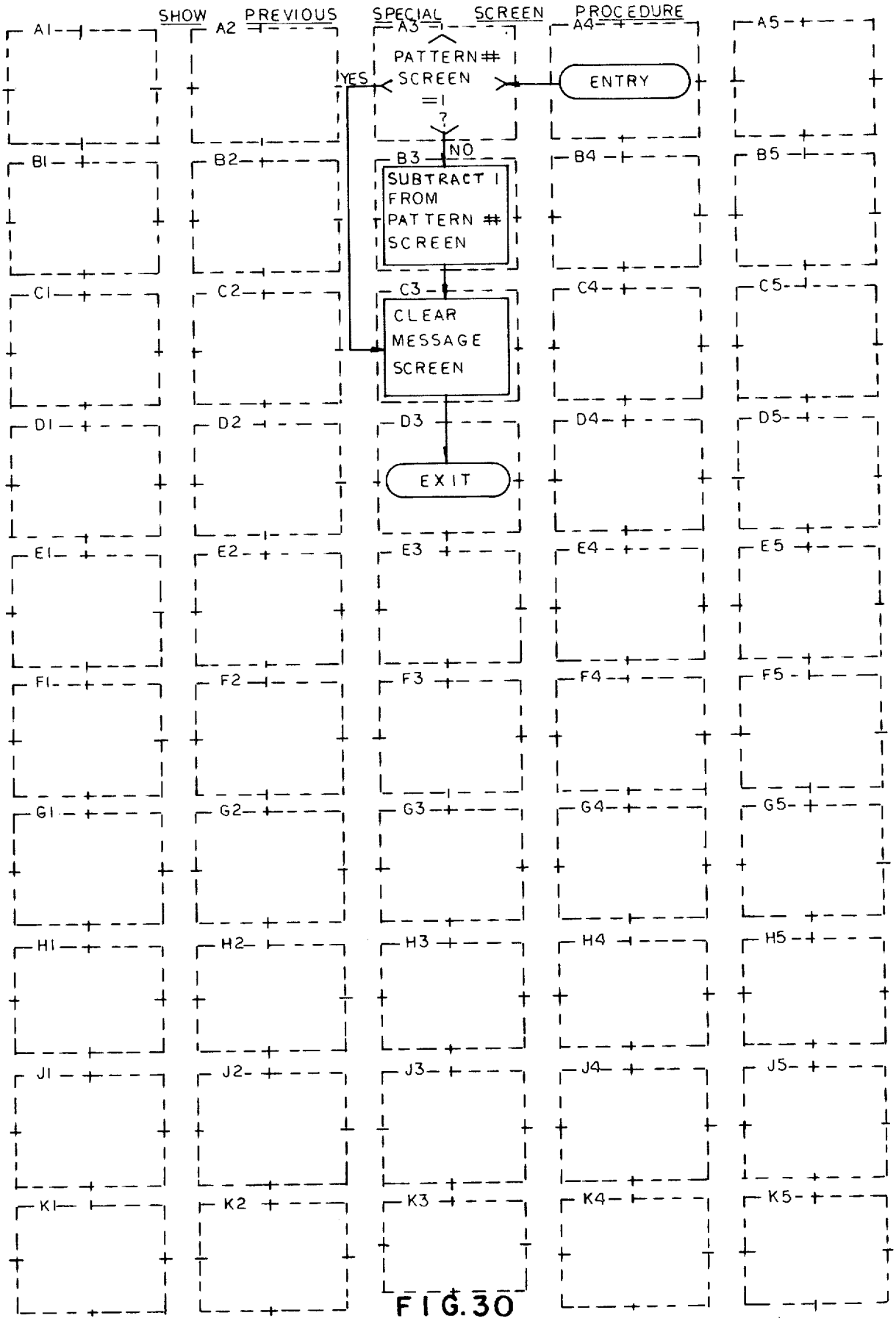
FIG. 30 is the flowchart of the Show Previous Special Screen Procedure.
Figure 31:
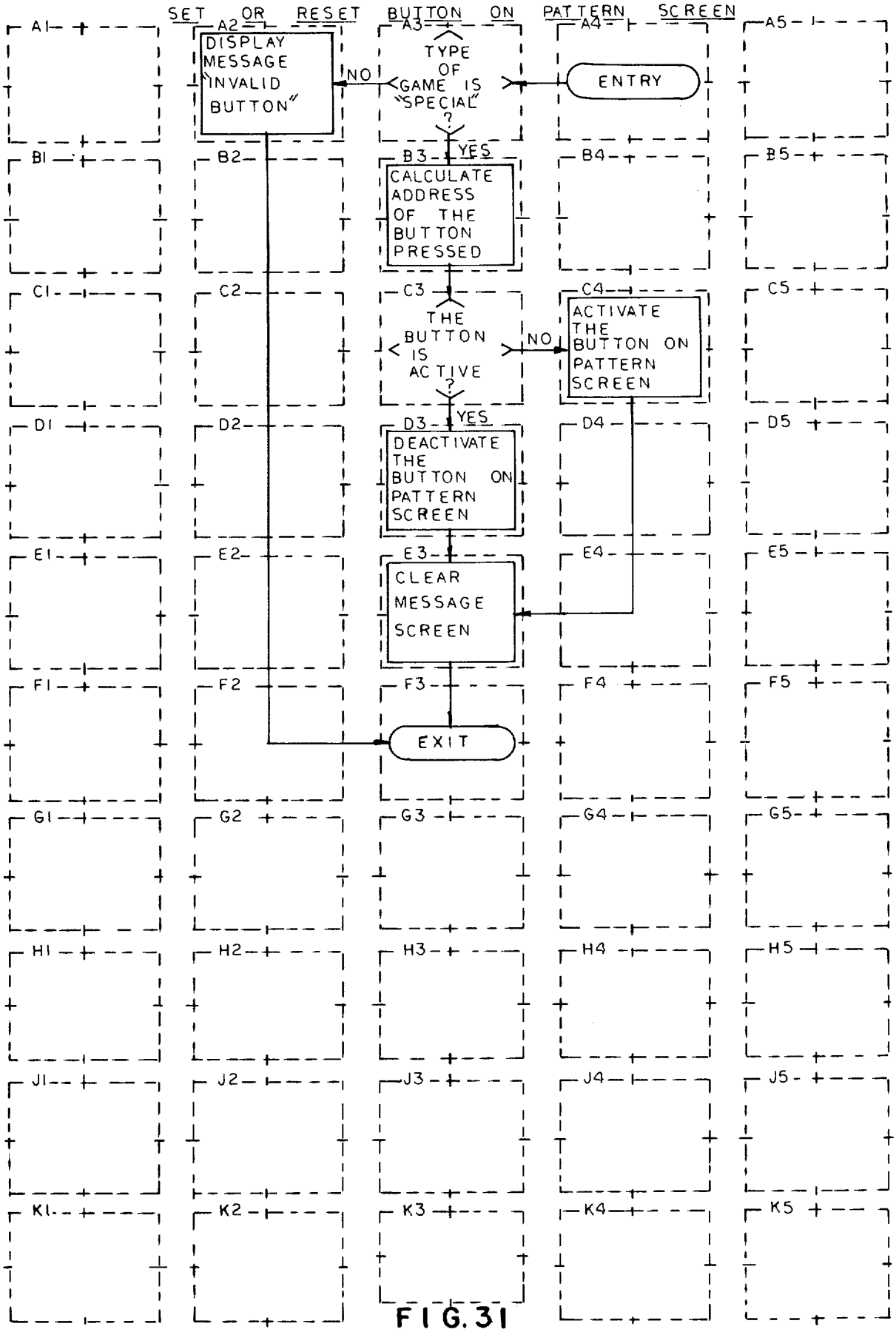
FIG. 31 illustrates the flowchart of the Set or Reset Button on Pattern Screen Procedure.
Figure 32:
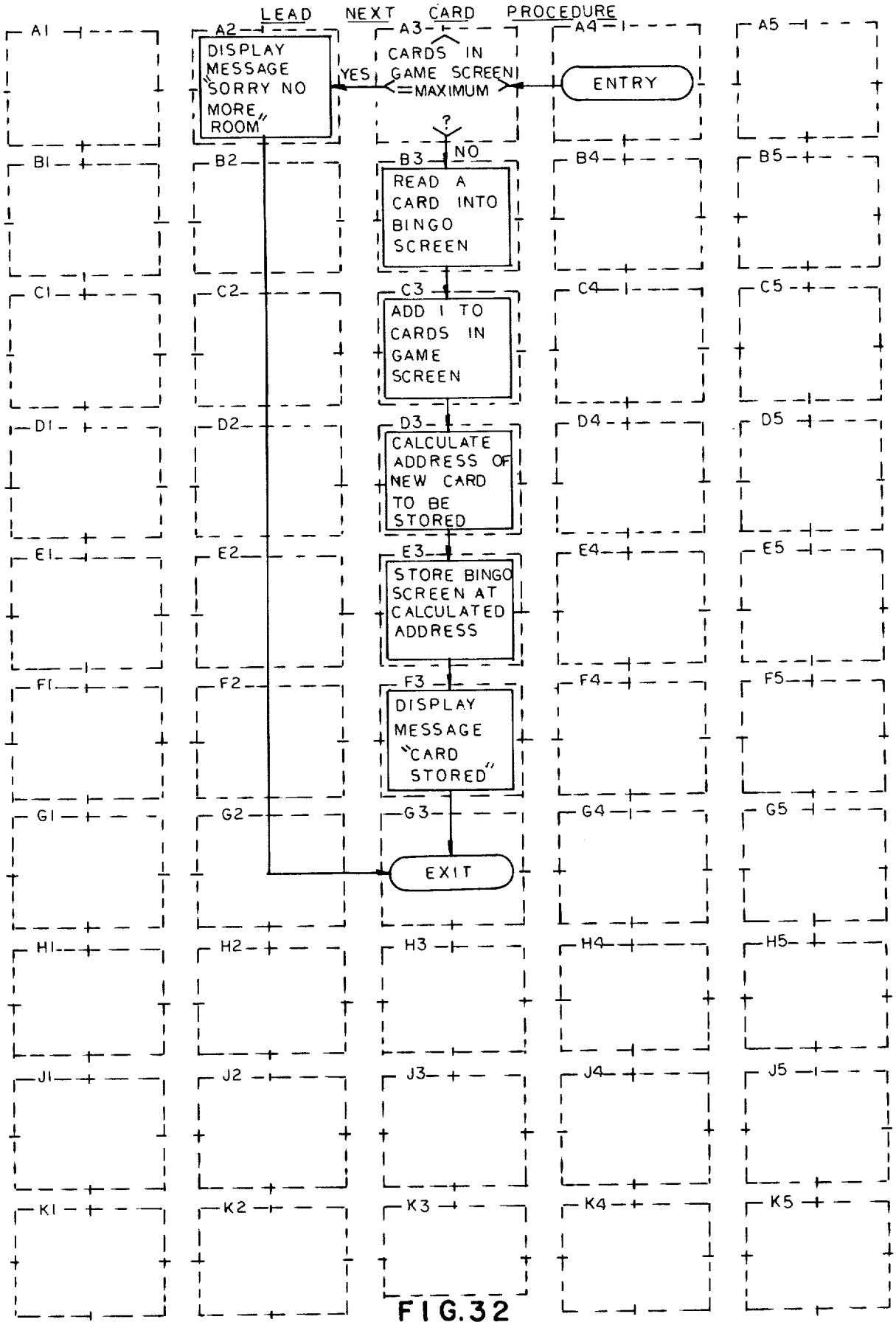
FIG. 32 shows the READ NEXT CARD Procedure flowchart.
Figure 33:
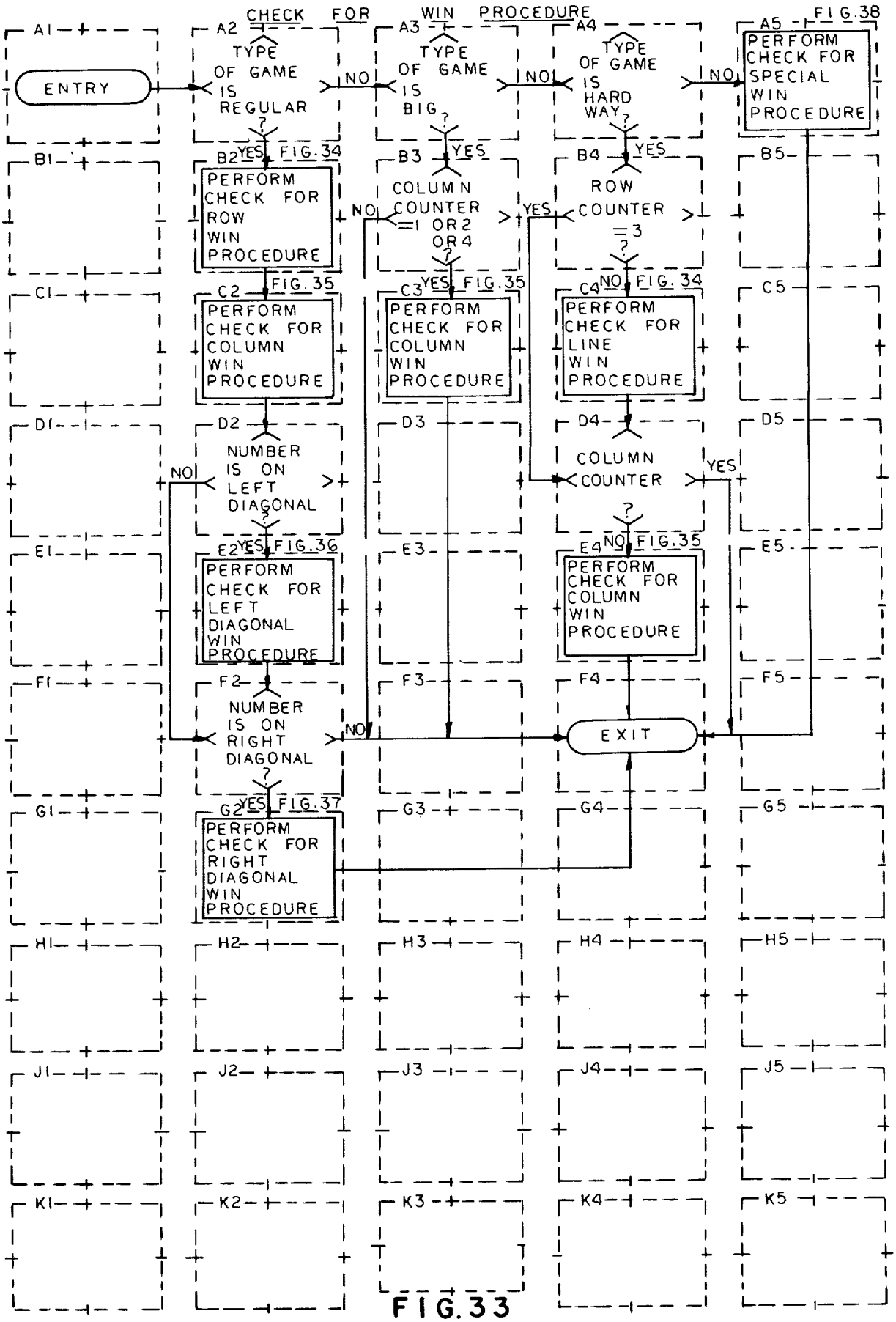
FIG. 33 depicts the Check for Win Procedure flowchart.
Figure 34:
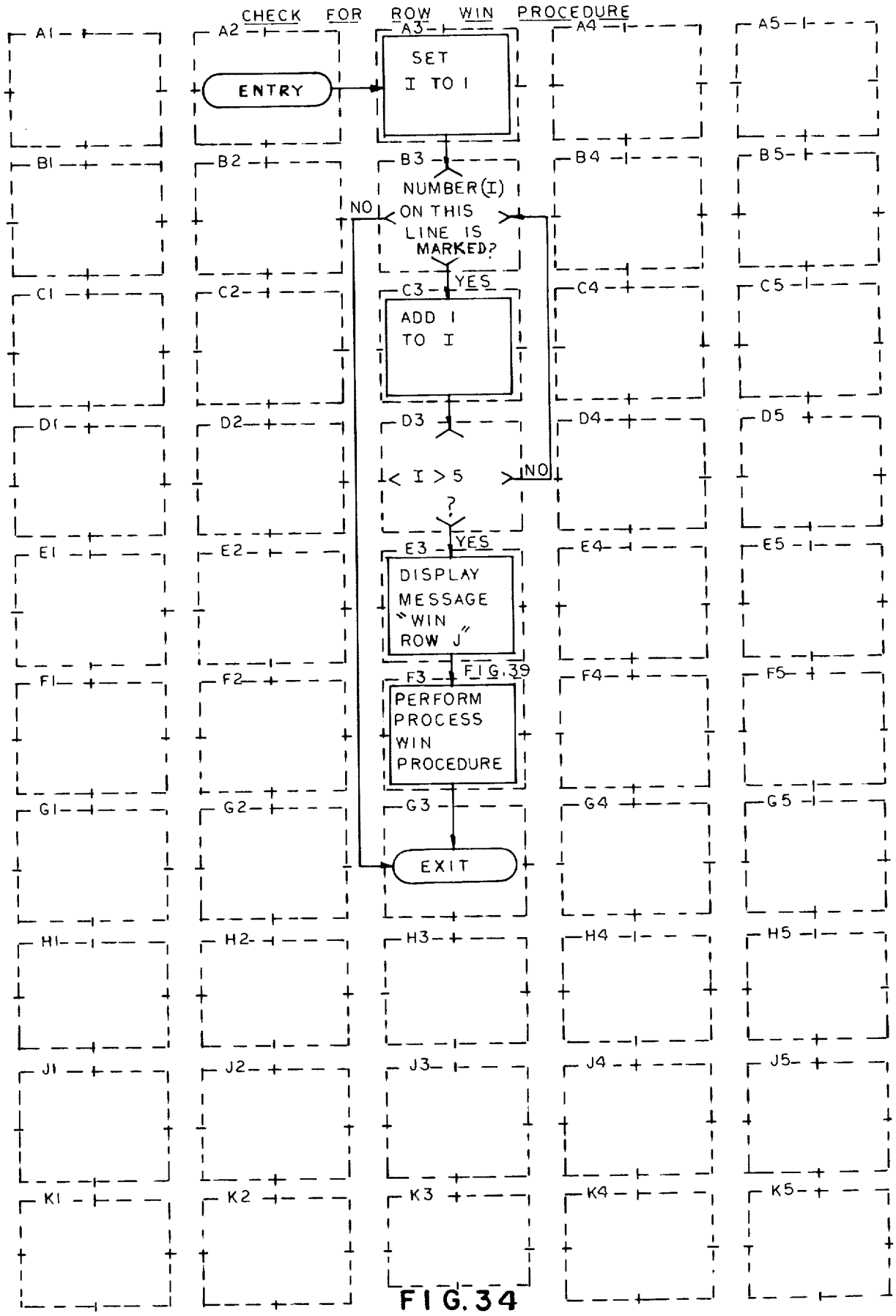
FIG. 34 represents the flowchart of the Check for Row Win Procedure.
Figure 35:
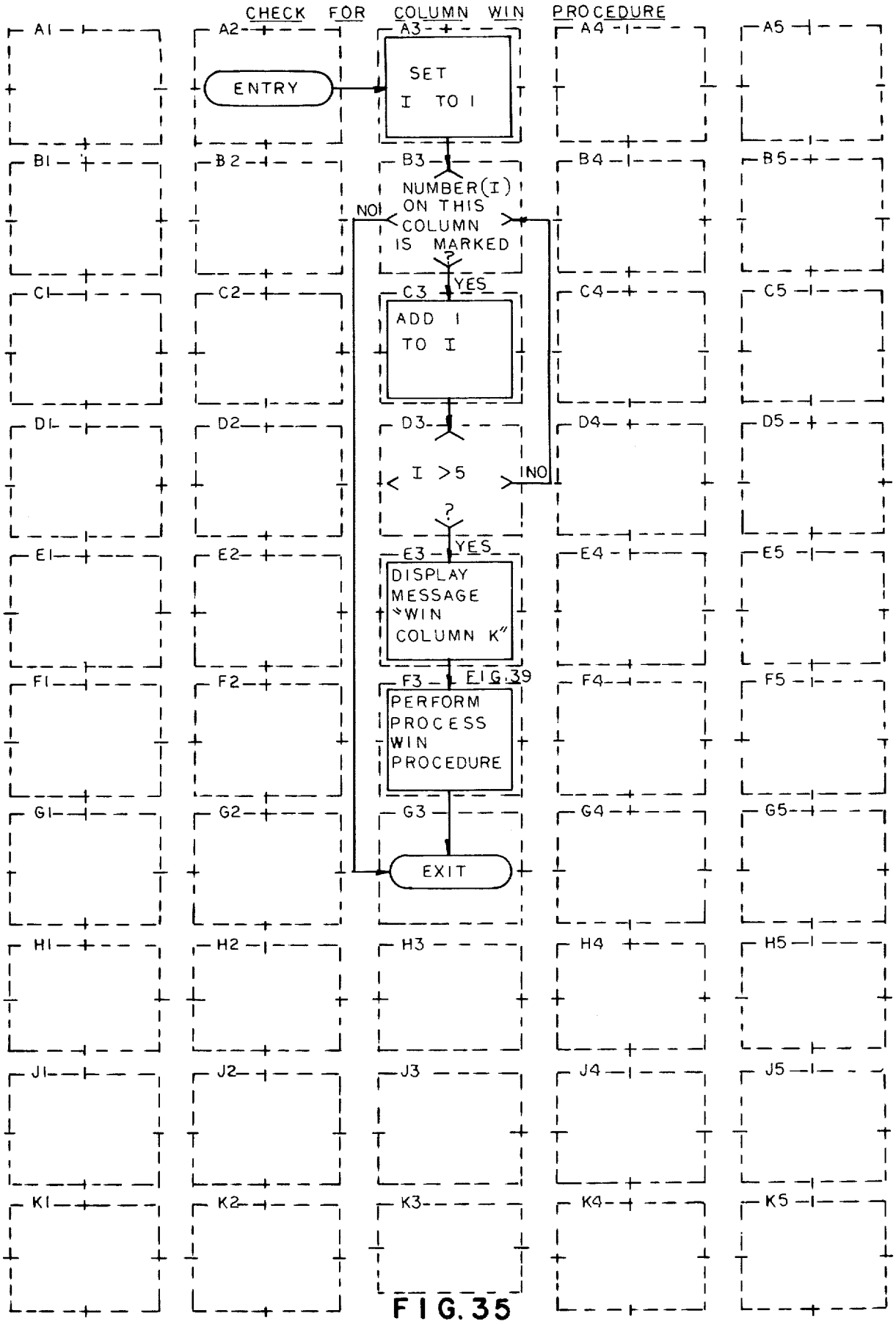
FIG. 35 is the flowchart of the Check for Column Win Procedure.
Figure 36:
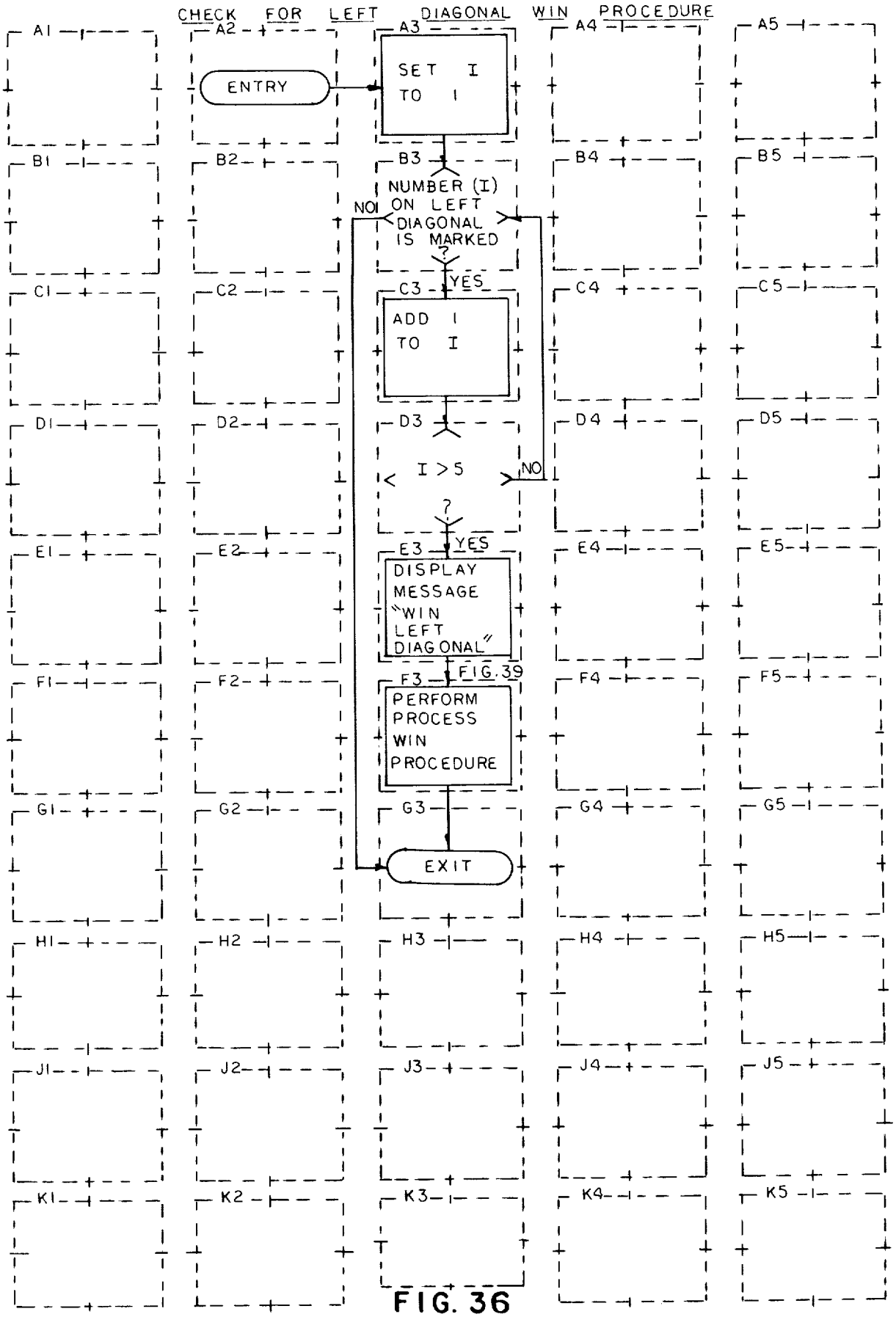
FIG. 36 is the flowchart of the Check for Left Diagonal Win Procedure.
Figure 37:
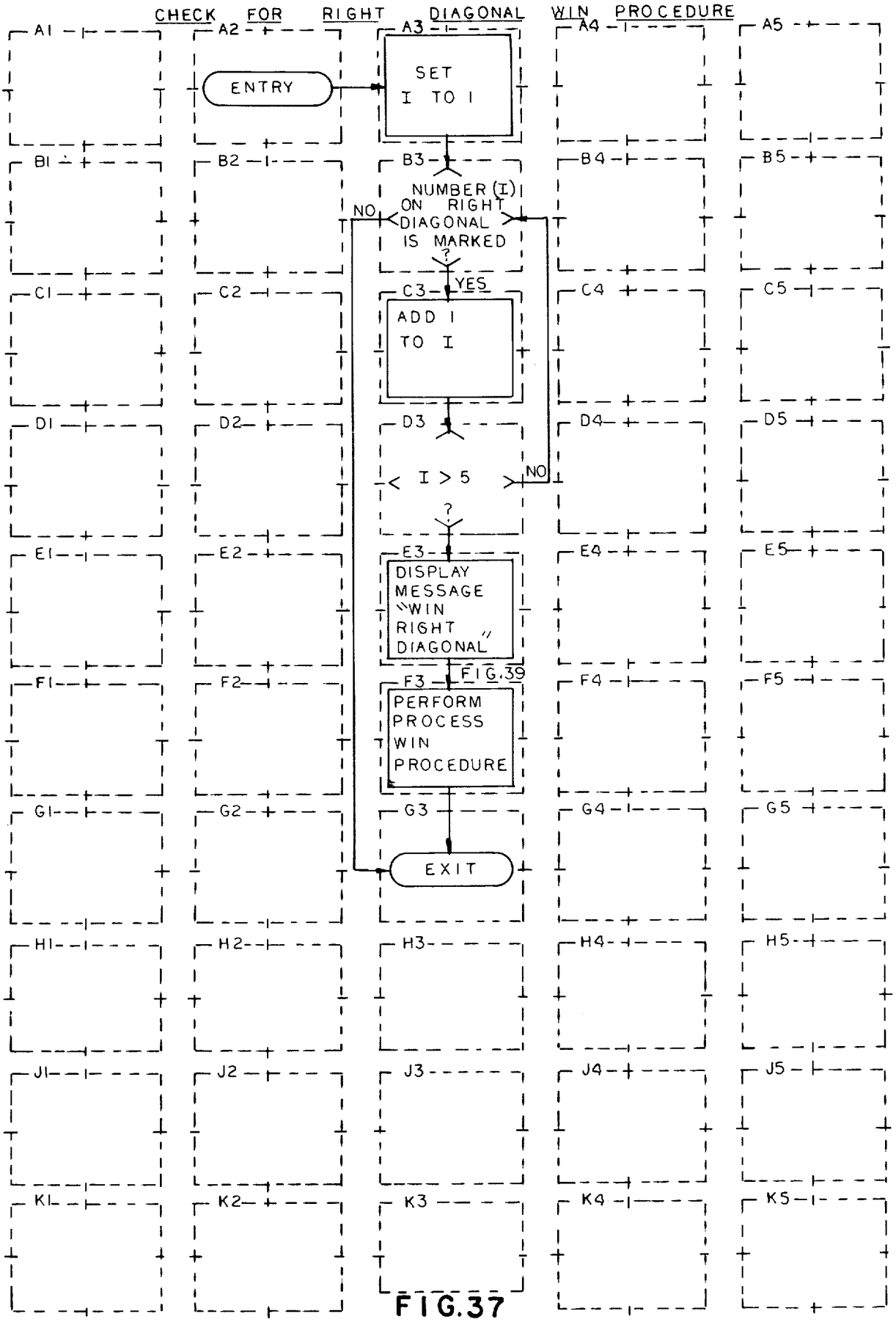
FIG. 37 represents the Check for Right Diagonal Win Procedure flowchart.
Figure 38:
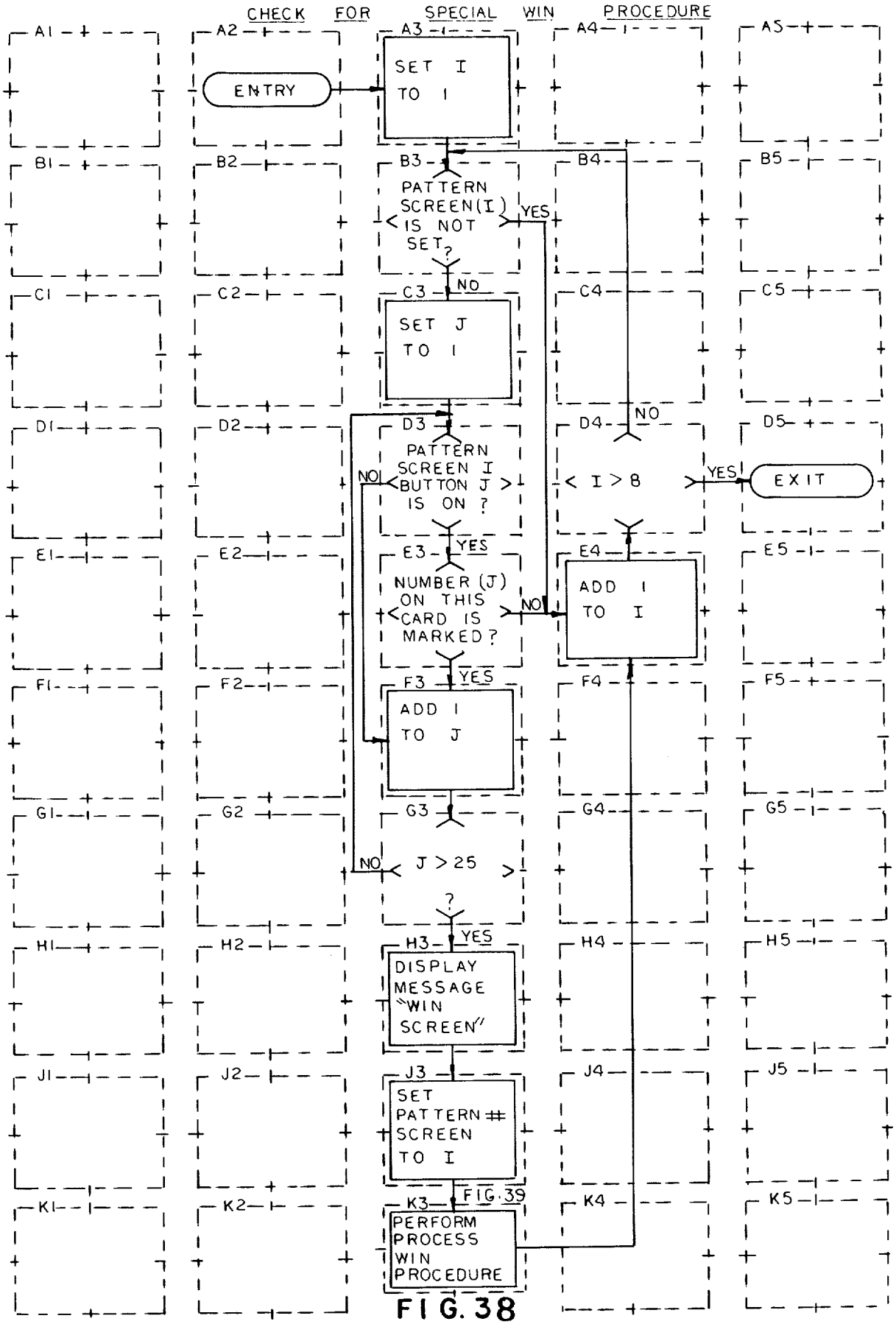
FIG. 38 depicts the flowchart of the Check for Special Win Procedure.
Figure 39:
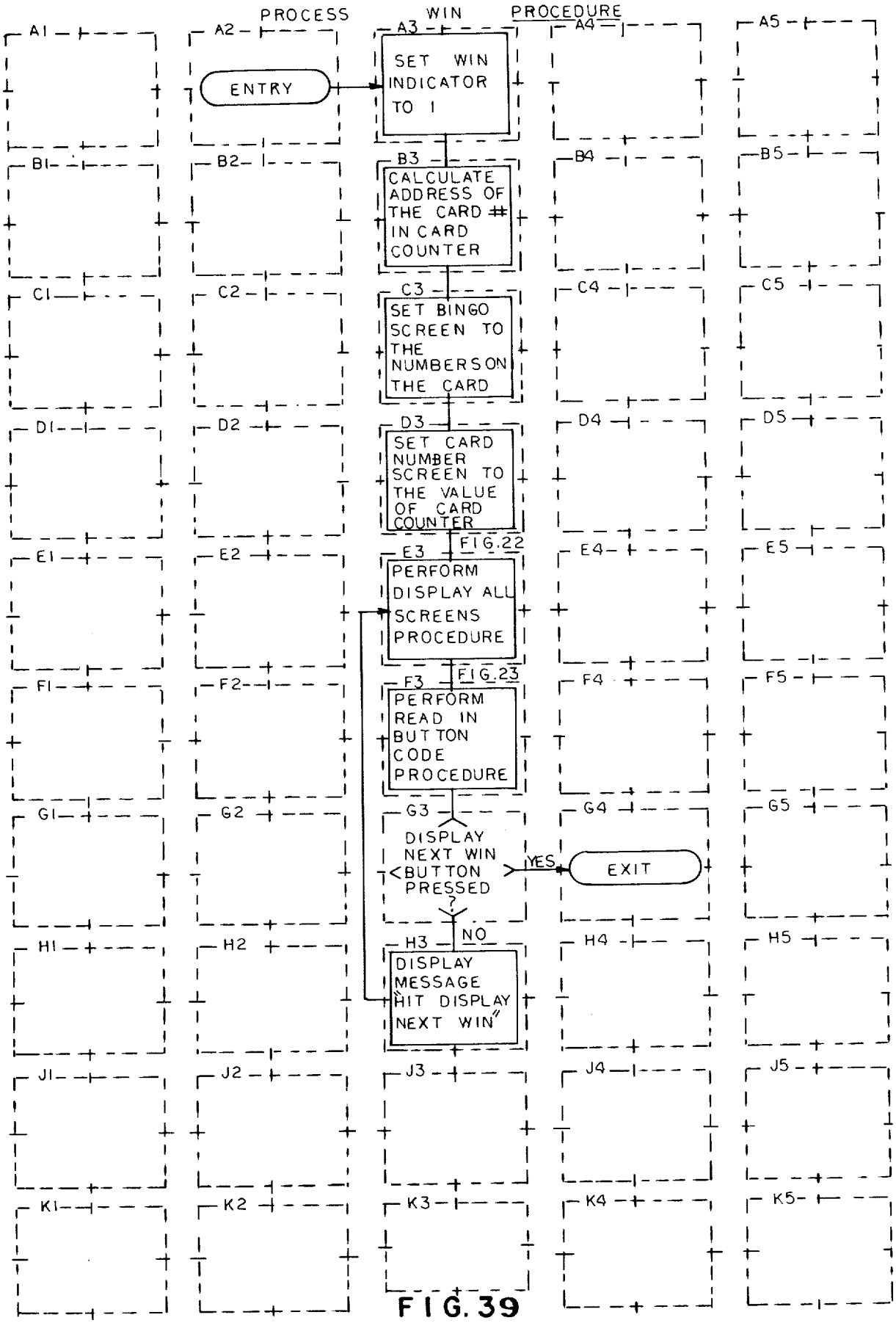
FIG. 39 is the flowchart of the Process Win Procedure.

The actual sensing circuitry of the card reader is realized here using a phototransistor as shown in FIG. 17*c*. The numbers (between one and fifteen inclusive) are coded in binary by punching holes in the Bingo card as appropriate, as shown in FIG. 18. A hole represents binary one while binary zero is represented by no hole. When the card is aligned on the assembly a phototransistor will be exposed to light wherever there is a hole in the card. When a phototransistor conducts it grounds the line to which its collector is attached and this output is in turn inverted to give the desired binary one output. Where there is no hole, the phototransistor does not conduct, the line is unaffected and a zero output results, as desired. The ring counter and the three-state inverters enable the lines to be grounded, where desired, selectively and sequentially.

Associated with the processor (not detailed here) are signals such as OUT (Output data to an I/O device), IN (Input data from an I/O device), MEMRQ (Memory Request), IORQ (Input/Output Request), RD (Read) and WR (Write). The signals MEMRQ, IORQ, RD and WR, or their equivalents, are usually generated by most of the more common microprocessors on the market while OUT and IN are usually obtained by appropriate combinations of the four mentioned earlier. Skilled practitioners of the art can generate the necessary signals for processors designed for I/O-mapped input/output, as assumed here, as well as for those processors requiring memory-mapped input/output.

Figure 3:
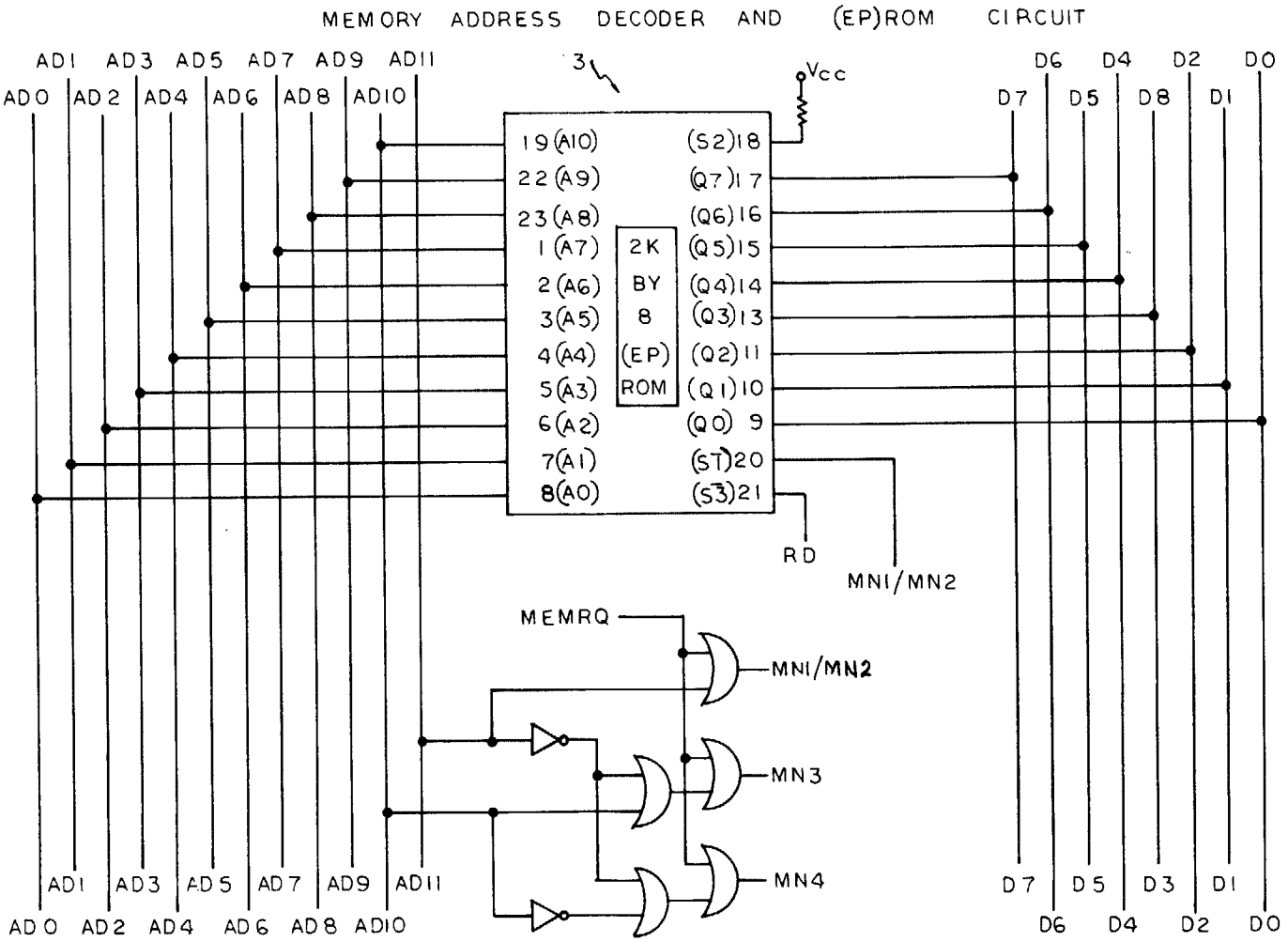
FIG. 3 represents the (EP)ROM interface circuit.
Figure 4:
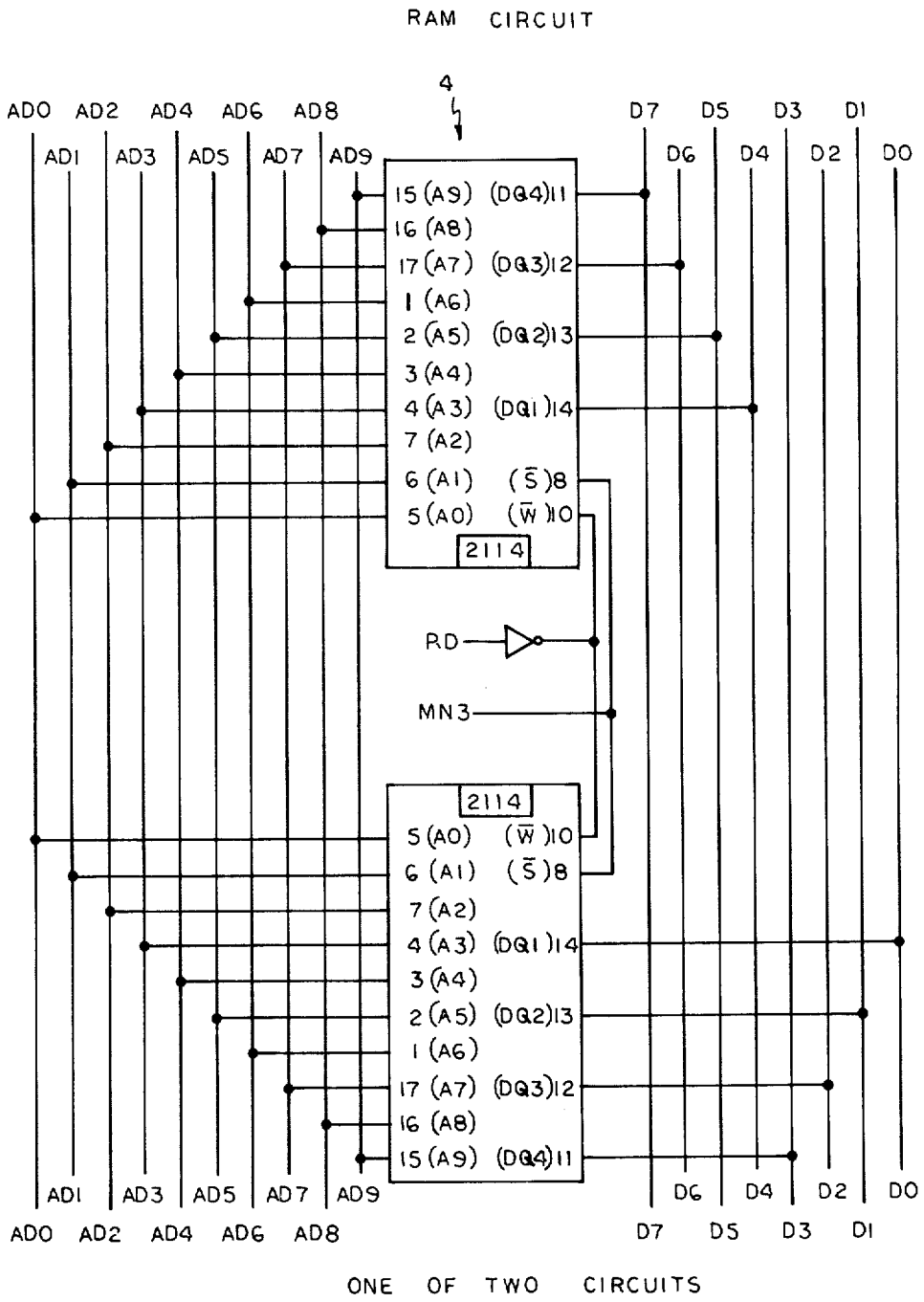
FIG. 4 represents the RAM interface circuit.

The ROM and RAM interface circuits are shown in FIGS. 3 and 4 and are self-explanatory. The optional audio module (not detailed here) is standard and a similar interface circuit is used to activate or deactivate it, all under program control.

The foregoing description is illustrative and does not limit the realization of the device to this particular embodiment. Practitioners of the art can realize the device in a host of other embodiments without deviating from the spirit and tenor of the present invention.

CONTROL PROGRAM LOGIC

The operation of the device is subject to the control program which resides in ROM 3. The whole program consists of one main procedure together with nineteen subroutines.

While the machine is on it operates at any time in one of two complementary and mutually exclusive modes: the pre-game (or PREParatory) mode and the game-in-process (or PLAY) mode. The pre-game mode is identified by the PREP (for preparatory) mode of the PREP/PLAY control button 20. Throughout the time that the pre-game mode is in effect the player can input his (or her) cards, select the type of game desired, input special patterns (for special games) and in general perform all other functions associated with these activities.

After making all necessary preparations, prior to the dealer calling out numbers, the player then pushes the PREP/PLAY control button 20 to place the device in the PLAY (or game-in-progress) mode. As long as the device is in this mode the player may push any one of the following control buttons, as appropriate:

(a) PREP/PLAY control button 20—to end the game and possibly start a new one.

(b) Any button on the numeric keyboard 23—to enter numbers called by the dealer.

(c) ENTER # control button 22—to record numbers called by the dealer and initiate a search for a possible win.

(d) DISPLAY NEXT WIN control button 21—to display other winning cards after the automatic display of the first winning card.

Each time the player pushes the PREP/PLAY control button 20, the device reverts to the conplementary mode. Thus the player can change the operational mode of the device at will. Initially (or on manual reset) the device assumes the PREP (or pre-game) mode.

The actual logic of the program is detailed in the flowcharts outlined in FIGS. 20–39. The program can be written in different languages for a variety of hardware. The program is modular with each module being represented by one flowchart. Each module has one entry point and one exit point, the only exception being the main procedure. The main procedure has no exit point since it ends only when the machine is switched off. Thus while the machine is on the main procedure operates in a dead loop. This procedure is written for execution in a conversational mode. In other words, to each command issued (by the player pushing a control button) the device either signals an error or else performs the required function and informs the player, as appropriate. In either case the device, after responding to a command, always waits for the player to issue another command. This interaction between the player and the device is maintained for as long as the device stays switched on.

While the foregoing specification outlines the realization of the device in one embodiment there is no suggestion here, directly or by implication that the said embodiment is the only possible one. Any practitioner who is skilled in the art can realize the device in a host of other embodiments differing in one or more of the details of the interface between the player and the device, the software/hardware interface, the hardware realization, the control program logic and the physical layout without deviating from the spirit, tenor and intent of this invention.

Accordingly we claim:

1. An electronic game, such as a bingo, a lotto and the like, comprising a plurality of data cards each including a set of numbers for a single card;

means for successively reading numbers on said data cards and subsequently storing a plurality of card images each consisting of the respective set of said numbers;

means for submitting by a player and storing a configuration pattern specifying sets of named positions on said card images which are considered to be winning;

means for successive inputting by a player a plurality of further numbers introduced by a dealer, comparing each of said thusly inputted further numbers with each number of each of said stored card images, and recording the numbers which coincide with said further inputted numbers;

displaying means including first means for determining and displaying the numbers of each card image on which the further numbers inputted by said inputting means have coincided with said set of positions specified by the configuration pattern submitted by said submitting means and which thereby is a winning card image; and start game means operative for switching off said reading means and said submitting means and switching on said inputting means and said determining means.

2. An electronic device defined in claim 1, wherein said first means includes a digital display and means for exposing on said digital display the set of numbers corresponding to said winning card image.

3. An electronic device defined in claim 2, wherein said exposing means is also operative for exposing on said digital display the set of numbers corresponding to each of the accumulated card images, before the activation of said game start means.

4. An electronic device defined in claim 3, wherein said display means includes second means having a second digital display and second exposing means for exposing on said second digital display a number of each of said successively read data carriers and thereby of each of said accumulated card images.

5. An electronic device defined in claim 4, wherein said second exposing means is also operative for exposing a number of said winning card.

6. An electronic device defined in claim 2, wherein said displaying means includes third means having a third digital display and a third exposing means for exposing the totality of the read data carriers and thereby the totality of accumulated card images.

7. An electronic device defined in claim 2, wherein said third displaying means includes a third digital display and third exposing means for exposing the further numbers inputted by the player.

8. An electronic device defined in claim 2, wherein said displaying means includes fourth means having an alpha-numeric display and fourth exposing means for exposing a name of all of said sets of winning positions on said winning card image.

9. An electronic device defined in claim 8, wherein said fourth exposing means is operative for exposing on said alphanumeric display error messages, status messages and instructional messages as occasioned during the playing of the game.

10. An electronic device defined in claim 6, wherein said third means is also operative for modifying a configuration pattern specifying sets of named positions on said card images which sets are considered to be winnings.

11. An electronic device defined in claim 10, wherein said third means includes displaying means for exposing a configuration pattern specifying sets of named positions on said card images which sets are considered to be winning.

* * * * *

US004378940B1

REEXAMINATION CERTIFICATE (3812th)

United States Patent [19] [11] B1 4,378,940

Gluz et al. [45] Certificate Issued Jul. 20, 1999

[54] ELECTRONIC DEVICE FOR PLAYING BINGO, LOTTO AND ALLIED CARD GAMES

[75] Inventors: Jacob Gluz, Foster City, Calif.; Benjamin Poku, New Haven, Conn.

[73] Assignee: Bingo Card Minder Corp.

Reexamination Request:
No. 90/004,989, May 18, 1998

Reexamination Certificate for:

| | |
|---|---|
| Patent No.: | **4,378,940** |
| Issued: | **Apr. 5, 1983** |
| Appl. No.: | **06/215,351** |
| Filed: | **Dec. 11, 1980** |

[51] Int. Cl.[6] ..... A63F 3/06

[52] U.S. Cl. ..... 273/237; 273/269

[58] Field of Search ..... 463/1, 16, 17, 463/18, 19, 30, 31, 25, 26, 36, 37; 273/237, 269; 364/410.1, 411.1, 412.1

[56] References Cited

U.S. PATENT DOCUMENTS 4,365,810 12/1982 Richardson .
4,373,726 2/1983 Churchill .

OTHER PUBLICATIONS

David H. Ahl: 101 Basic Computer Games (book) 1st printing Jul. 1973 pp. 3–5, 36–38, 133, 134 Digital Equipment Corporation Maynard, Massachusetts 01754.

*Primary Examiner*—Jessica J. Harrison

[57] ABSTRACT

An electronic device comprising a master controller, numeric and alphanumeric displays, a numeric keyboard, control buttons, a pattern-input switch matrix, a card-input assembly and an optional audio module—all in one unit—automatically reads coded numbers on a card, accepts numbers as well as patterns whereupon it indicates by visual and optionally audible means when a win (i.e. "BINGO") occurs. The basic device can easily be adapted so it can be used to play other card games besides BINGO, (e.g. LOTTO).

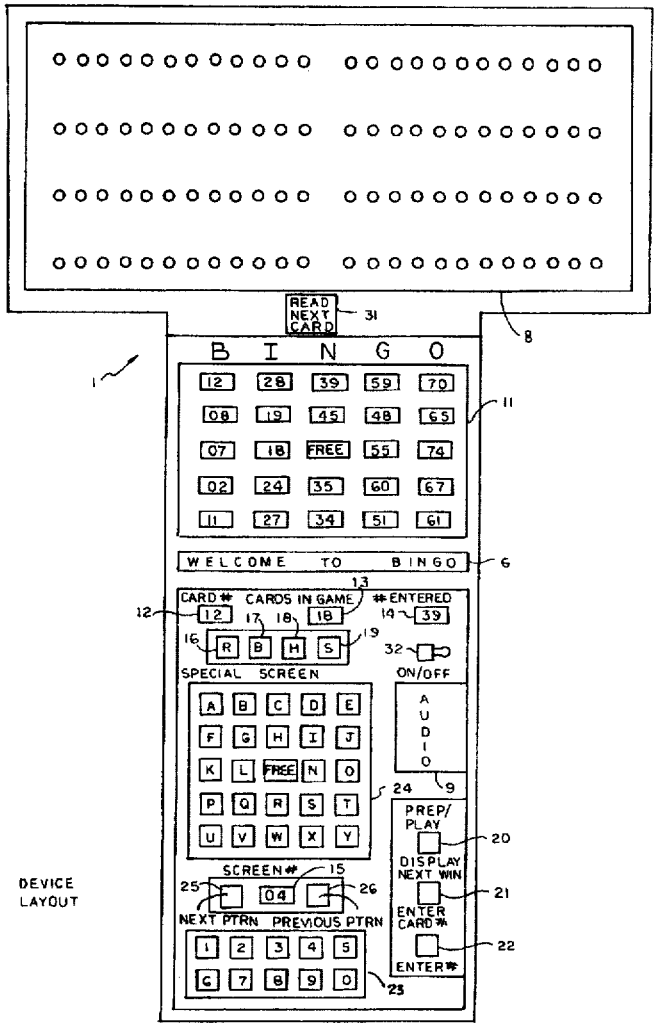

DEVICE LAYOUT

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *

US004378940B2

REEXAMINATION CERTIFICATE (4089th)

United States Patent [19] [11] B2 4,378,940

Gluz et al. [45] Certificate Issued May 23, 2000

[54] ELECTRONIC DEVICE FOR PLAYING BINGO, LOTTO AND ALLIED CARD GAMES

[75] Inventors: Jacob Gluz, Foster City, Calif.; Benjamin Poku, New Haven, Conn.

[73] Assignee: Bingo Technologies Corporation, Stateline, Nev.

Reexamination Request:
No. 90/005,341, Apr. 23, 1999

Reexamination Certificate for:

| | |
|---|---|
| Patent No.: | **4,378,940** |
| Issued: | **Apr. 5, 1983** |
| Appl. No.: | **06/215,351** |
| Filed: | **Dec. 11, 1980** |

Reexamination Certificate B1 4,378,940 issued Jul. 20, 1999

[51] Int. Cl.[7] ..... A63F 3/06
[52] U.S. Cl. ..... 273/237; 273/269
[58] Field of Search ..... 463/1, 16–19, 463/30–31, 25–26, 36–37; 273/237, 269, 274; 700/91–93

[56] References Cited

U.S. PATENT DOCUMENTS

| | | | |
|---|---|---|---|
| D. 182,488 | 4/1958 | Wichinsky | D34/5 |
| 2,760,619 | 8/1956 | Peak | 194/16 |
| 4,365,810 | 12/1982 | Richardson | 273/237 |
| 4,373,726 | 2/1983 | Churchill et al. | 273/138 |

OTHER PUBLICATIONS

David H. Ahl, 101 Basic Computer Games (book), 1st printing Jul. 1973, pp. 3–5, 36–38, 133, 134, Digital Equipment Corporation, Maynard, Massachusetts 01754.

*Primary Examiner*—Mark A Sager

[57] ABSTRACT

An electronic device comprising a master controller, numeric and alphanumeric displays, a numeric keyboard, control buttons, a pattern-input switch matrix, a card-input assembly and an optional audio module—all in one unit—automatically reads coded numbers on a card, accepts numbers as well as patterns whereupon it indicates by visual and optionally audible means when a win (i.e. "BINGO") occurs. The basic device can easily be adapted so it can be used to play other card games besides BINGO, (e.g. LOTTO).

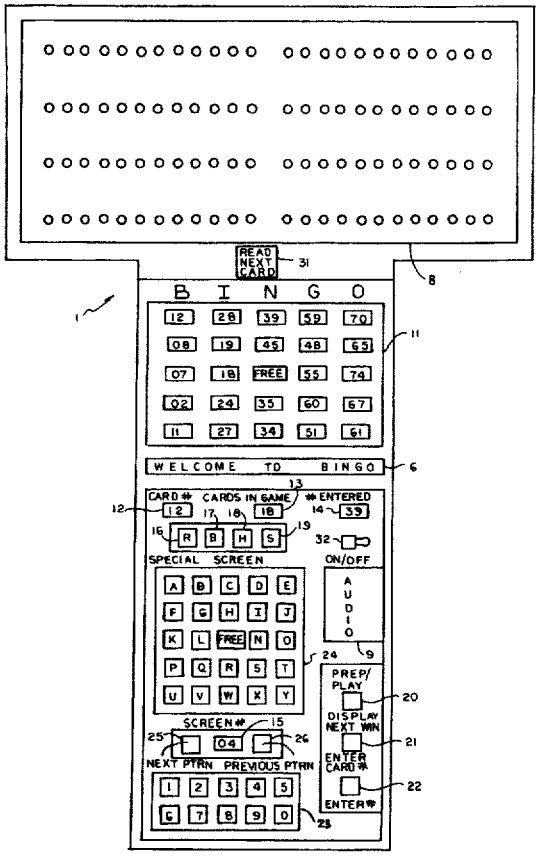

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2–11 is confirmed.

* * * * *